US008041284B2

(12) United States Patent
Watanabe et al.

(10) Patent No.: US 8,041,284 B2
(45) Date of Patent: Oct. 18, 2011

(54) AUTOMATIC DOCUMENT FEEDER DEVICE AND IMAGE FORMING DEVICE

(75) Inventors: Takashi Watanabe, Toyokawa (JP); Toshikazu Higashi, Toyokawa (JP); Takeshi Ishida, Toyohashi (JP); Masahiro Nonoyama, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/408,530

(22) Filed: Mar. 20, 2009

(65) Prior Publication Data

US 2009/0309287 A1 Dec. 17, 2009

(30) Foreign Application Priority Data

Jun. 13, 2008 (JP) ..... 2008-154936

(51) Int. Cl.
*G03G 15/00* (2006.01)

(52) U.S. Cl. ..... 399/367; 271/3.14; 355/75

(58) Field of Classification Search ..... 399/367, 399/370, 371; 271/3.14; 355/75
See application file for complete search history.

(56) References Cited

U.S. PATENT DOCUMENTS 3,467,469 A * 9/1969 Hastings et al. ..... 355/67
3,724,949 A * 4/1973 Kanno et al. ..... 355/75
3,944,365 A * 3/1976 Van Buskirk ..... 355/75
4,439,036 A * 3/1984 Davis et al. ..... 355/75
4,449,811 A * 5/1984 Betron et al. ..... 399/380
4,548,491 A * 10/1985 Eiland ..... 399/107
5,126,787 A * 6/1992 Irie et al. ..... 355/75
5,832,356 A * 11/1998 Kurando et al. ..... 399/367

FOREIGN PATENT DOCUMENTS

| | | |
|---|---|---|
| JP | 60-63840 | 5/1985 |
| JP | 6-332082 | 12/1994 |
| JP | 07-271115 | 10/1995 |
| JP | 2003-280114 | 10/2003 |
| JP | 2006-050225 | 2/2006 |

OTHER PUBLICATIONS

Japanese Notification of Reasons for Refusal mailed on Apr. 20, 2010, directed to Japanese Patent Application No. 2008-154936; 4 pages.

* cited by examiner

*Primary Examiner* — Kaitlin Joerger
(74) *Attorney, Agent, or Firm* — Morrison & Foerster LLP

(57) ABSTRACT

An automatic document feeder device 100 has a device body 110 disposed on a platen 210 of a document reading device 200 and pivotably openable relative to the device 200 by being hingedly connected thereto. The device 100 includes detectors 130, 140 for detecting a document-stack state of at least one of a feeder and an output tray 111, 112 provided on the body 110, a driver 160 for driving the body 110 to be pivotably opened in an upward direction from the platen 210, an instructor 179 for giving an instruction for the driving, and a controller 172 for, based on a detection result of the detectors 130, 140 in priority to the instruction, to permit or forbid the driving, or to control an amount of the driving. When the device body is automatically opened, documents in the feeder or the output tray are unlikely to fall off.

12 Claims, 24 Drawing Sheets

| DOCUMENT | AMOUNT | OPEN/CLOSE POSITION |
|---|---|---|
| PRESENT | LARGE | LOW POSITION |
| | SMALL | HIGH POSITION |
| ABSENT | — | FULLY OPEN POSITION |

| DOCUMENT | SIZE | OPEN/CLOSE POSITION |
|---|---|---|
| PRESENT | LARGE | LOW POSITION |
| | SMALL | HIGH POSITION |
| ABSENT | — | FULLY OPEN POSITION |

| DOCUMENT | SIZE | AMOUNT | OPEN/CLOSE POSITION |
|---|---|---|---|
| PRESENT | LARGE | LARGE | LOW POSITION |
| | | SMALL | MEDIUM POSITION |
| | SMALL | LARGE | MEDIUM POSITION |
| | | SMALL | HIGH POSITION |
| ABSENT | — | — | FULLY OPEN POSITION |

| DOCUMENT | AMOUNT | OPEN/CLOSE SPEED |
|---|---|---|
| PRESENT | LARGE | LOW SPEED |
| | SMALL | HIGH SPEED |
| ABSENT | — | ULTRAHIGH SPEED |

FIG. 20

| DOCUMENT | SIZE | OPEN/CLOSE SPEED |
|---|---|---|
| PRESENT | LARGE | LOW SPEED |
| | SMALL | HIGH SPEED |
| ABSENT | — | ULTRAHIGH SPEED |

FIG. 22

| DOCUMENT | SIZE | AMOUNT | OPEN/CLOSE SPEED |
|---|---|---|---|
| PRESENT | LARGE | LARGE | LOW SPEED |
| | | SMALL | MEDIUM SPEED |
| | SMALL | LARGE | MEDIUM SPEED |
| | | SMALL | HIGH SPEED |
| ABSENT | — | — | ULTRAHIGH SPEED |

FIG. 23A WHEN DOCUMENT IS ABSENT IN TRAY
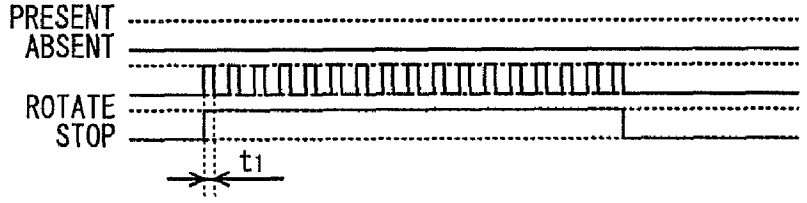
FIG. 23B WHEN DOCUMENT AMOUNT AND SIZE ARE SMALL
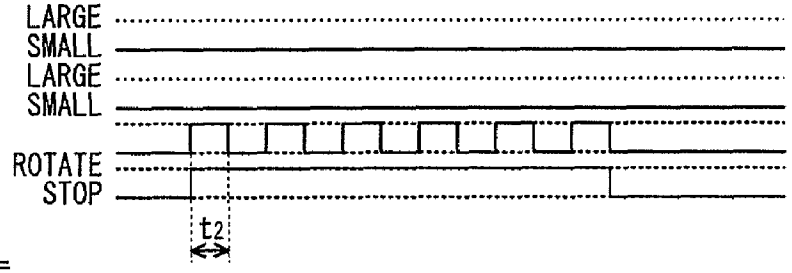
FIG. 23C WHEN DOCUMENT AMOUNT IS LARGE AND SIZE IS SMALL
WHEN DOCUMENT AMOUNT IS SMALL AND SIZE IS LARGE
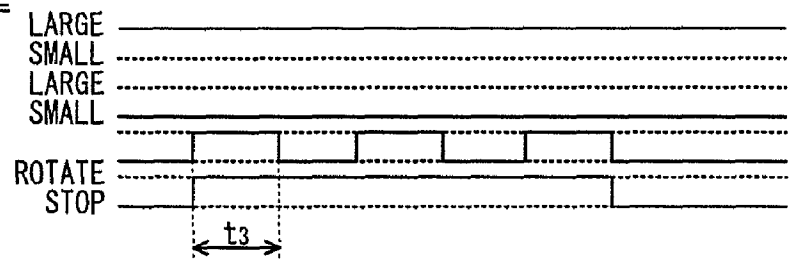
FIG. 23D WHEN DOCUMENT AMOUNT AND SIZE ARE LARGE
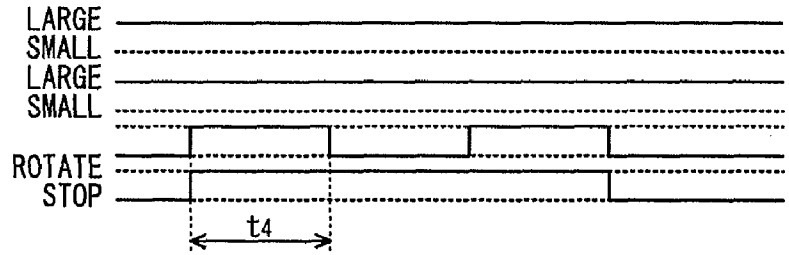

FIG. 24

| DOCUMENT | AMOUNT | OPEN/CLOSE POSITION | OPEN/CLOSE SPEED |
|---|---|---|---|
| PRESENT | LARGE | LOW POSITION | LOW SPEED |
| | SMALL | HIGH POSITION | HIGH SPEED |
| ABSENT | — | FULLY OPEN POSITION | ULTRAHIGH SPEED |

FIG. 26

| DOCUMENT | SIZE | OPEN/CLOSE POSITION | OPEN/CLOSE SPEED |
|---|---|---|---|
| PRESENT | LARGE | LOW POSITION | LOW SPEED |
| | SMALL | HIGH POSITION | HIGH SPEED |
| ABSENT | — | FULLY OPEN POSITION | ULTRAHIGH SPEED |

FIG. 28

| DOCUMENT | SIZE | AMOUNT | OPEN/CLOSE POSITION | OPEN/CLOSE SPEED |
|---|---|---|---|---|
| PRESENT | LARGE | LARGE | LOW POSITION | LOW SPEED |
| | | SMALL | MEDIUM POSITION | MEDIUM SPEED |
| | SMALL | LARGE | MEDIUM POSITION | MEDIUM SPEED |
| | | SMALL | HIGH POSITION | HIGH SPEED |
| ABSENT | — | — | FULLY OPEN POSITION | ULTRAHIGH SPEED |

AUTOMATIC DOCUMENT FEEDER DEVICE AND IMAGE FORMING DEVICE

This application is based on application No. 2008-154936 filed in Japan, the contents of which are hereby incorporated by reference.

BACKGROUND OF THE INVENTION (1) Field of the Invention

The present invention relates to an automatic document feeder device and an image forming device provided with a feeder that feeds documents stacked in a feeder tray to a document reader of a document reading device and ejects the read documents to an output tray. Particularly, the present invention relates to a technique for automatically opening and closing a device body of the automatic document feeder device relative to the document reading device.

(2) Description of the Related Art

In general, according to the image forming device as described above, the device body of the automatic document feeder device is hingedly connected to the document reading device by a hinge connector. By pivoting about a hinge shaft of the hinge connector, the device body is opened and closed. In recent years, in order to improve the operability of the device and to be more user-friendly for the handicapped, an automatic assist opening/closing system for automatically opening and closing the device body according to user's button operation has been proposed (JP-A-H07-271115, JP-A-2006-50225).

However, according to the image forming device provided with the automatic assist opening/closing system, when the device body is widely or abruptly opened, documents stacked on the feeder tray and/or the output tray may fall off. Particularly, when an amount and/or a size of the stacked documents is large, the documents are likely to fall off.

SUMMARY OF THE INVENTION

The present invention is conceived in view of the above problems. It is an object of the present invention therefore to provide an automatic document feeder device and an image forming device whose documents stacked on a feeder tray or an output tray thereof are unlikely to fall off when a device body of the automatic document feeder device is automatically opened.

To achieve the above object, one aspect of the present invention provides an automatic document feeder device having a device body disposed on a platen of a document reading device, the device body being pivotably openable relative to the document reading device by being hingedly connected thereto, the automatic document feeder device including a detector operable to detect a document-stack state of at least one of a feeder tray and an output tray provided on the device body, a driver operable to drive the device body to be pivotably opened in an upward direction from the platen, an instructor operable to give an instruction such that the driver drives the device body, and a controller operable, when receiving the instruction from the instructor and based on a detection result of the detector, to (i) permit or forbid the driver to drive the device body or (ii) control an amount of the driving.

In addition, another aspect of the present invention provides an image forming device that includes an automatic document feeder device having a device body disposed on a platen of a document reading device, the device body being pivotably openable relative to the document reading device by being hingedly connected thereto, the image forming device including a detector operable to detect a document-stack state of at least one of a feeder tray and an output tray provided on the device body, a driver operable to drive the device body to be pivotably opened in an upward direction from the platen; an instructor operable to give an instruction such that the driver drives the device body, and a controller operable, when receiving the instruction from the instructor and based on a detection result of the detector, to (i) permit or forbid the driver to drive the device body or (ii) control an amount of the driving.

The automatic document feeder device and the image forming device according to one aspect of the present invention has the detector that detects a document-stack state of at least one of the feeder tray and the output tray provided on the device body, the driver that drives the device body to be pivotably opened in an upward direction from the platen, and the controller that, based on a detection result of the detector, permit or forbid the driving, or controls an amount of the driving. Thus, when documents stacked on the feeder tray or the output tray may fall off as a result of opening operation of the device body, the device body can be opened in a manner less likely to cause the fall of the documents. Accordingly, if the device body is opened with the use of the automatic assist opening/closing system, documents stacked on the feeder tray and/or the output tray are unlikely to fall off.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings:

FIG. 6 is a time chart showing the opening operation processing in accordance with Embodiment 1 of the present invention;

FIG. 8 is a time chart showing the opening operation in accordance with Embodiment 2 of the present invention;

FIG. 10 is a time chart showing the opening operation in accordance with Embodiment 3 of the present invention;

FIG. 19 is a time chart showing opening operation in accordance with Embodiment 7 of the present invention;

FIG. 20 is a diagram showing a content of an opening information table in accordance with Embodiment 8 of the present invention;

FIG. 21 is a time chart showing opening operation in accordance with Embodiment 8 of the present invention;

FIG. 22 is a diagram showing a content of an opening information table in accordance with Embodiment 9 of the present invention;

FIG. 23 is a time chart showing opening operation in accordance with Embodiment 9 of the present invention;

FIG. 23A shows when documents are absent in the feeder tray;

FIG. 23B shows when a small amount of small-sized documents are present in the feeder tray;

FIG. 23C shows when a large amount of small-sized documents and a small amount of large-sized documents are present in the feeder tray;

FIG. 23D shows when a large amount of large-sized documents are present in the feeder tray;

FIG. 24 is a diagram showing a content of an opening information table in accordance with Embodiment 10 of the present invention;

FIG. 25 is a time chart showing opening operation in accordance with Embodiment 10 of the present invention;

FIG. 26 is a diagram showing a content of an opening information table in accordance with Embodiment 11 of the present invention;

FIG. 27 is a time chart showing opening operation in accordance with Embodiment 11 of the present invention;

FIG. 28 is a diagram showing a content of an opening information table in accordance with Embodiment 12 of the present invention; and FIG. 29 is a time chart showing opening operation in accordance with Embodiment 12 of the present invention;

DESCRIPTION OF THE PREFERRED EMBODIMENT

The following describes, as a preferred embodiment of the present invention, an automatic document feeder device and an image forming device applied to a digital color copying machine (hereinafter simply referred to as "copying machine") by way of example.

[Structure of Automatic Document Feeder Device and Image Forming Device]

Figure 1:
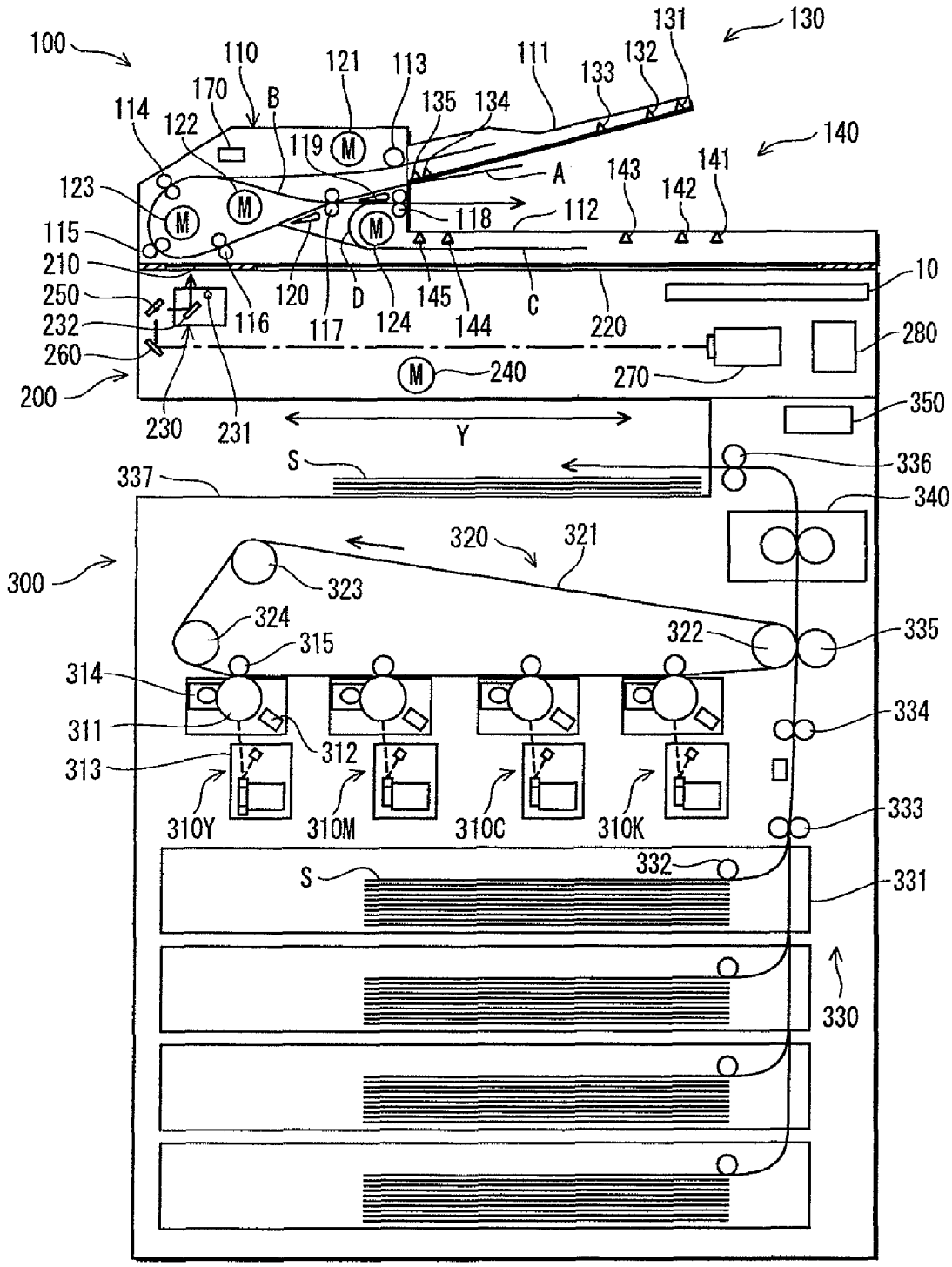
FIG. 1 is a configuration diagram schematically showing an overall structure of a copying machine in accordance with an embodiment of the present invention.

As shown in FIG. 1, a copying machine 1 in accordance with an embodiment of the present invention is roughly composed of an ADF unit 100 as an automatic document feeder device for automatically feeding documents, a scanner unit 200 as a document reading device for reading documents, and a printer unit 300 for reproducing a read image onto a recording sheet by printing the image thereonto. The copying machine 1 is so structured that a document image can be read both by a sheet-through system which is one of fixed optical type systems and a scanner-moving system which is one of mobile optical type systems.

Note that the sheet-through system is a system for reading a document by moving the document, with the optical system kept motionless (fixed). The scanner-moving system is a system for reading a document by moving, relative to the document, a mirror that leads light reflected from a document surface to a CCD sensor, with a length of an optical path between a document reading position and the CCD sensor maintained and with the document kept motionless.

The ADF unit 100 includes a device body 110, detectors 130, 140, hinge connectors 150 (see FIG. 2), a driver 160 (see FIG. 3), and an ADF controller 170. The ADF controller 170 includes an open/close controller 172 as a controller and an open/close instructor 179 as an instructor for giving an instruction so that the driver 160 is driven.

The device body 110 includes a feeder composed of a feeder tray 111, an output tray 112, various rollers 113-118 and switching claws 119-120, and various motors 121-124. According to the sheet-through system, documents stacked on the feeder tray 111 are separated one by one and a document is conveyed to a platen (platen glass 210 used for the sheet-through system) of a scanner unit 200, and a read document is ejected to the output tray 112. Switching can be made between a one-face reading mode for reading one face of a document and a both-face reading mode for sequentially reading both faces (front face and rear face) of a document by reversing the document.

In the one-face reading mode, a document at the top of a stack of documents having been set in the feeder tray 111 is separated from the document stack by a feed roller 113 and conveyed to the first reading roller pair 115 via the first resist roller pair 114. After a tilt (skew) of the document is corrected here, the document is conveyed to the platen glass 210 by the first reading roller pair 115. When the document is passing the document reading position on the platen glass 210, an image on the document is read. The document having passed through the platen glass 210 is conveyed to the output roller pair 118 via the second reading roller pair 116 and the second resist roller pair 117, and the output roller pair 118 ejects the document to the output tray 112.

On the other hand, in the both-face reading mode, a position of the switching claw 119 is switched before a surface of a document is read. A document of which a surface has been read is conveyed to a path A from the second reading roller pair 116 and the second resist roller pair 117 via the switching claw 119. The document of which an originally back-end has become a top-end as a result of switch-back is conveyed to a path B, and is further to the platen glass 210 by the first reading roller pair 115. At that time, the rear face of the document is opposed to a surface of the platen glass 210. Accordingly, when the document is passing the document reading position, an image on the rear face of the document is read. The document of which the image on the rear face has been read is conveyed to a path C from the second reading roller pair 116 via the switching claw 120. The document is conveyed to a path D, with an originally back-end thereof being a top-end as a result of the switch-back. The output roller pair 118 ejects the document to the output tray 112.

The feeder roller 113 is driven by the feeder motor 121. The first resist roller pair 114 and the second resist roller pair 117 are driven by the resistor motor 122. The first reading roller pair 115 and the second reading roller pair 116 are driven by the reader motor 123. The output roller pair 118 is driven by the ejector motor 124. Each of the above rollers is driven to rotate by an unshown power transmission system and the like. Each of the motors 121-124 is a stepping motor, for example.

Figure 2:
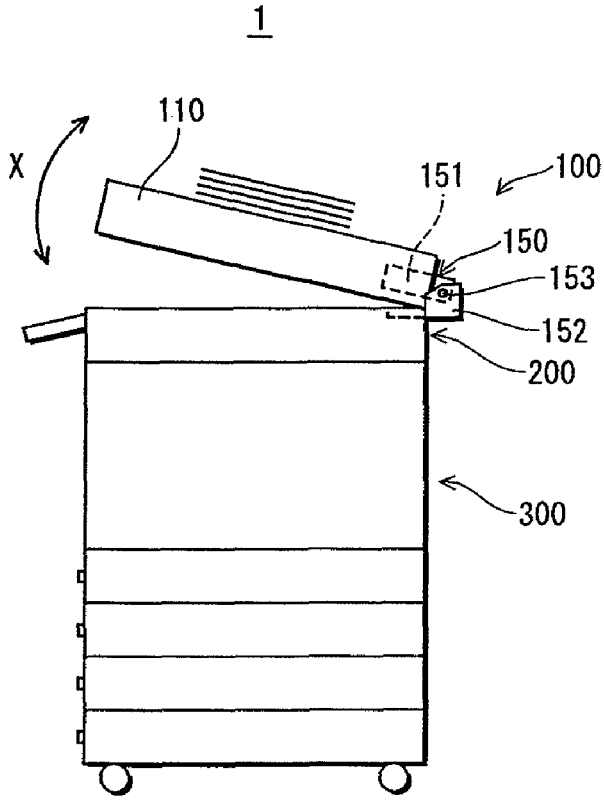
FIG. 2 is a schematic view showing a connection state of an ADF unit and a scanner unit connected by hinge connectors.

The device body 110, disposed on the scanner unit 200, has the feeder tray 111 and the output tray 112 disposed externally thereof, and the rollers 113-118, the switching claws 119, 120 and the motors 121-124 stored therein. As shown in FIG. 2, the device body 110 is pivotable about a hinge shaft 153 of each hinge connector 150 in a direction X. Due to this pivoting, the device body 110 is openable relative to the scanner unit 200.

Referring back to FIG. 1, the detector 130 is disposed in the vicinity of the feeder tray 111, and the detector 140 is disposed in the vicinity of the output tray 112. When a user presses an "open/close" key of a later-described control panel 10, the detectors 130 and 140 detect document-stack states of documents stacked on those trays 111 and 112 (hereinafter, simply "trays" indicates both the feeder tray and the output tray). Note that the detection timing is not limited to when the "open/close" key is pressed. For example, the detection may be regularly performed when the copying machine 1 is being operated.

More specifically, the detector 130 has first-third length detection sensors 131-133 for detecting a length of documents stacked on the feeder tray 111, a width detection sensor 134 for detecting a width of the documents, and a height detection sensor 135 for detecting a height of the documents. The first-third length detection sensors 131-133 and the width detection sensor 134 detect presence or absence, and a size of documents, respectively, as the document-stack state. The height detection sensor 135 detects presence or absence and an amount of documents as the document-stack state.

Similarly, the detector 140 has first-third length detection sensors 141-143 for detecting a length of documents stacked on the output tray 112, a width detection sensor 144 for detecting a width of the documents, and a height detection sensor 145 for detecting a height of the documents. The first-third length detection sensors 141-143 and the width detection sensor 144 detect presence or absence and a size of documents as the document-stack state. The height detection sensor 145 detects presence or absence and an amount of documents as the document-stack state. Note that the document amount is indicated by a thickness of documents (document stack), and that in this case the documents include one or a plurality of sheets.

More specifically, the first-third length detection sensors 131-133 (141-143) and the width detection sensor 134 (144) are each an optical-reflection-typed sensor having a light-emitting device and a light-receiving device. The light-emitting device is continuously operated or intermittently operated at a given timing, and reflected light is received at the light-receiving device. Referring to the increase and the decrease in an amount of the received light, the sensor judges whether a documents is present at the position of each sensor. An electric signal on which photoelectric conversion has been made at the light-receiving device is outputted to the ADF•CPU 171 (FIG. 4) as the document-stack state information.

In addition, the height detection sensor 135 (145) is a distance-surveying sensor provided with the light-emitting device and the light-receiving device, and determines a distance to a reflective surface that is an upper surface of the document stack with the use of the triangulation principle. The electric signal on which photoelectric conversion has been made at the light-receiving device is outputted to the ADF•CPU 171 as the document-stack state information.

Note that the detection sensors 131-135 and 141-145 are not limited to the above structures, and are satisfactory as long as a length, width and height of documents can be detected. For example, an optical sensor other than the optical-reflection-typed sensor or a mechanical sensor having a mechanism for detecting a shifting distance of a lever with the use of a volume resistance is also applicable.

As shown in FIG. 2, each hinge connector 150 has a first fixture 151 being fixed to the device body 110, a second fixture 152 being fixed to the scanner unit 200, and the hinge shaft 153 connecting the first fixture 151 and the second fixture 152. Thus, the hinge connectors 150 connect the device body 110 and the scanner unit 200. Note that there are two pairs of the hinge connectors 150, and that the two pairs are spacedly disposed at two points in a direction Y in FIG. 1.

The first fixture 151 is fixed to the hinge shaft 153. When the hinge shaft 153 is rotated, the first fixture 151 is cooperated with the rotation to be pivoted around the hinge shaft 153. When the first fixture 151 is pivoted, the device body 110 having the first fixture 151 fixed thereon is also pivoted around the hinge shaft 153. As a result, the device body 110 is opened and closed relative to the scanner unit 200.

Figure 3:
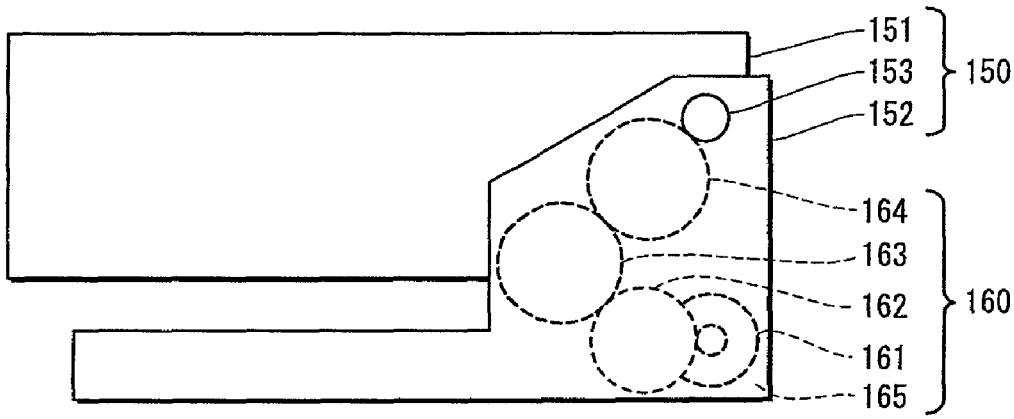
FIG. 3 is a configuration diagram schematically showing a structure of each of the hinge connectors and a driver.

The driver 160 is for opening and closing the device body 110 by driving the hinge shaft 153 to be rotated. As shown in FIG. 3, the driver 160 has an open/close motor 161, reduction gears 162-164 for transmitting rotation driving force of the open/close motor 161 to the hinge shaft 153, and an open/close angle detection sensor 165 for detecting an angle for opening and closing the device body 110. Those constituents are built in the hinge connectors 150. Note that the driver 160 may be built in one or each of the hinge connectors 150.

The open/close motor 161 is a stepping motor that is controlled by the open/close controller 172 (FIG. 4) to rotate in a forward and reverse direction at a given rotating speed. The rotation driving force of the open/close motor 161 is transmitted to the reduction gears 162-164. The reduction gears 162-164 slow down the rotation to a given speed, and transmits the rotation driving force applied by the open/close motor 161 to the hinge shaft 153. Thus, the hinge shaft 153 is rotated in the forward and reverse direction, thereby opening and closing the device body 110. The open/close angle detection sensor 165 is a rotary-type volume (variable resistor) that converts a rotation angle of the hinge shaft 153 to voltage, and outputs an electric signal of the voltage to the ADF•CPU 171 as rotation angle information.

Note that, in this embodiment, the stepping motor is used as a driving source thereof, however, other electric motor, air cylinder or the like may be used.

Figure 4:
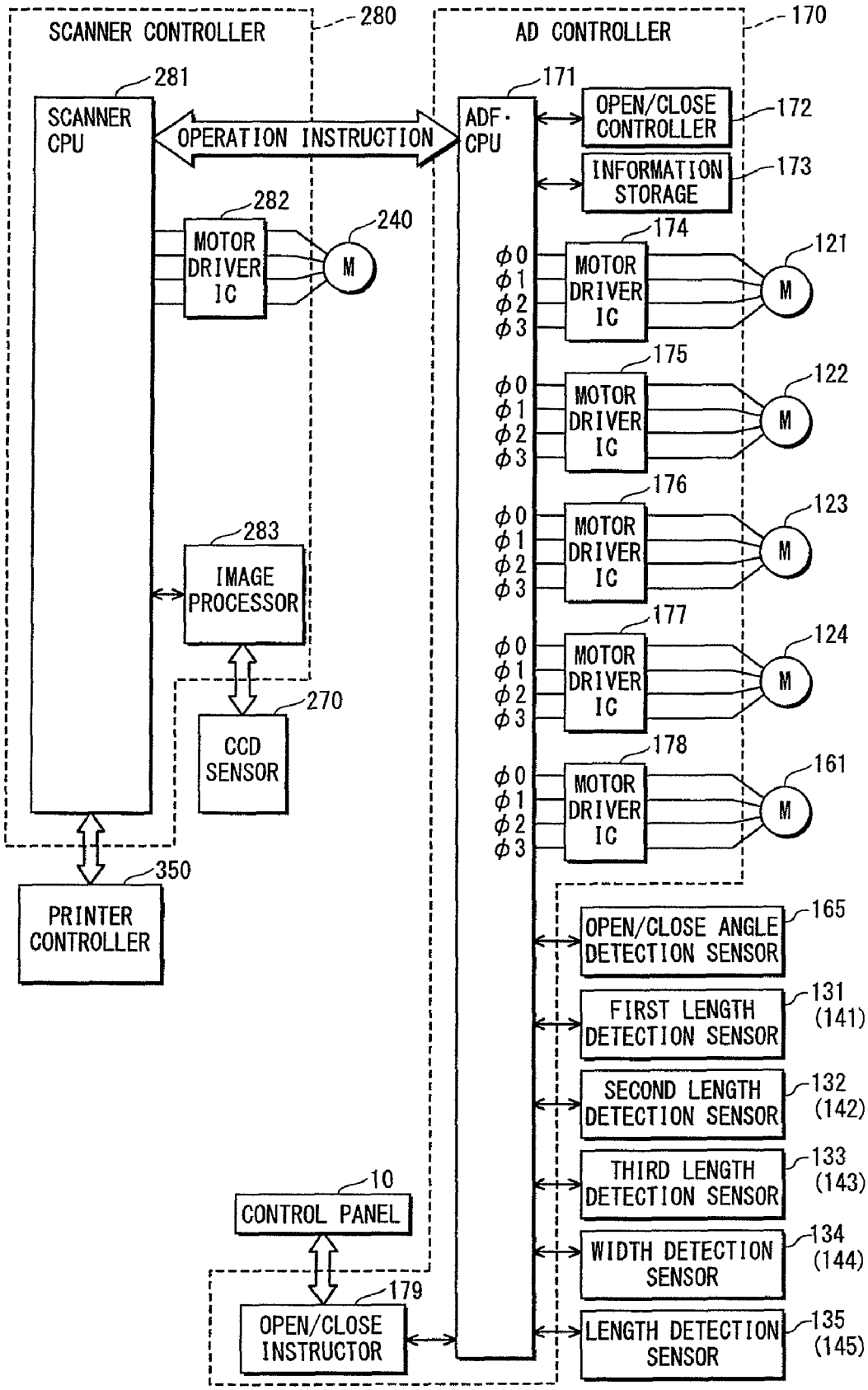
FIG. 4 is a block diagram showing a structure of each of an ADF controller, a scanner controller, and a printer controller.

As shown in FIG. 4, the ADF controller 170 mainly has the the ADF•CPU 171, the open/close controller 172, an information storage 173, motor driver ICs 174-178, and a ROM (unshown) for storing therein program necessary for controlling the above constituents and a RAM (unshown) which is a work area when the program is executed.

In response to the instruction given by the open/close instructor 179, the open/close controller 172 controls the driving of the driver 160. More specifically, the open/close controller 172 receives operating information outputted by the control panel 10 via the open/close instructor 179 as the instruction given by the open/close instructor 179. Based on the operating information, the open/close controller 172 controls the driver 160 to drive the open/close motor 161 so as to open and close the device body 110. Furthermore, the open/close controller 172 restrains the driver 160 from driving the device body 110, or controls a driving amount of the driver 160, based on a detection result of the detectors 130 and 140 in priority to the instruction given by the open/close instructor 179. More specifically, based on the document-stack state outputted by the detectors 130 and 140 and the rotation angle information outputted by the open/close detection sensor 165, the open/close controller 172 controls the device body 110 so that the device body 110 is not at all opened, slightly opened, or slowly opened. A more specific content of the control is described later.

The motor driver ICs 174-177 are driver ICs for driving the motors 121-124, respectively. The motor driver IC 178 is a driver IC for driving the open/close motor 161. In response to receiving excitation signals ϕ0-ϕ3 from the ADF•CPU 171, the motor driver ICs 174-178 drive the respective motors 121-124 to be rotated.

The information storage 173 is a nonvolatile memory, and stores therein an opening information table storing therein opening information (see FIGS. 11, 14, 16, 18, 20, 22, 24, 26 and 28). The opening information is information on opening angle and/or opening speed of the device body 110 being automatically opened (uplifted from the platen glass 210). The opening angle and/or opening speed are determined in advance for each document-stack state, from the viewpoint of whether documents are likely to fall.

Herein, the document-stack state of the documents means a state of the documents stacked on the feeder tray 111 or the output tray 112, and indicates, for example, presence or absence, an amount, a size and the like of the documents. The opening angle is an angle formed between the platen and the device body 110 when the device body 110 is opened. In addition, the opening speed is a speed when the device body 110 is being opened.

Referring back to FIG. 1, the scanner unit 200 includes the platen glass 210 for the sheet-through system, a platen glass 220 for manual operation, a scanner 230, a scanner motor 240, mirrors 250 and 260, a CCD sensor 270, and a scanner controller 280.

A document passing the above platen glass 210 for the sheet through system is radiated by a light source 231 of the scanner 230 that is motionless below the platen glass 210. A light path of light reflected from the document surface is modified by mirrors 232, 250 and 260 of the scanner 230. An image is formed on the CCD sensor 270 by a collection lens (unshown), and the image is photoelectrically converted to an image signal. The photoelectrically converted image signal is transmitted to the printer unit 300 after being publicly-known image processing is performed by the scanner controller 280.

In addition to the platen glass 210 for the sheet-through system, the scanner unit 200 is provided with the platen glass 220 for manual operation opposing the device body 110. To read a document mounted on the platen glass 220 for manual operation (when read in the scanner-moving system), the device body 110 is opened upward, and the document is set on the platen glass 220 for manual operation. With the document set, the rotation of the scanner motor 240 moves the scanner 230 in a direction Y in FIG. 1. Thus, an image on the document is read.

As shown in FIG. 4, the scanner controller 280 has a scanner CPU 281, a motor driver IC 282, an image processor 283, and a ROM (unshown) for storing therein a program necessary for controlling the above constituents, a RAM (unshown) which is a work area when the program is executed, and an image memory (unshown).

The motor driver IC 282 is a driver IC for driving the scanner motor 240. When a stepping motor is applied as the scanner motor 240, for example, in response to receiving excitation signals ϕ0-ϕ3 from the scanner CPU 281, the motor driver IC 282 drives the scanner motor 240 to be rotated.

The image processor 283 generates an image signal for printing by performing various processing, such as publicly-known shading correction or tone correction to an image signal from the CCD sensor 270, and stores the image signal in an image memory. The image signal stored in the image memory is read when printed, such as copying, and used for printing.

The printer unit 300 is for forming an image on a recording sheet S with the use of a generally-known electrophotographic technology. The printer unit 300 includes image formers 310Y, 310M, 310C, and 310K, respectively, for yellow, magenta, cyan, and black, and an intermediate transfer part 320, a fed paper conveyor 330, a fixer 340, a printer controller 350 and the like. The printer unit 300 forms (print) the document image on the recording sheet S, based on the image signal from the scanner controller 280.

The image formers 310Y-310K are spacedly arranged in series along an intermediate transfer belt 321 of the intermediate transfer part 320. Each of the image formers 310Y-310K includes a photoreceptor drum 311, a charger 312, an exposure part 313, a developer 314, a primary transfer roller 315 and the like.

The intermediate transfer part 320 includes the intermediate transfer belt 321, a driving roller 322 and driven rollers 323 and 324, and the like on which the intermediate transfer belt 321 is suspended in a tensioned state.

The fed paper conveyor 330 includes a plurality of feed cassettes 331 that contain sheets, a feeding roller 332 that feeds sheets of the feed cassettes 331 one sheet at a time, a convey roller pair 333 that conveys the sheets along a conveyance path, a timing roller pair 334 that adjusts a timing at which to send the fed sheet to a secondary transfer position, a secondary transfer roller 335 that forcibly abuts the driving roller 322 with the intermediate transfer belt 321 therebetween, and an output roller pair 336.

In response to receiving a drive signal from the image processor 283 of the scanner unit 200, each exposure part 313 emits the laser beam, and scans the laser beams across each photoreceptor drum 311 in a main scanning direction. Before the scanning, toner remaining on a surface of each photoreceptor drum 311 is removed by a cleaner (unshown) and the electricity of the photoreceptor drum 311 is removed by radiation by an eraser lamp (unshown). Subsequently, the photoreceptor drum 311 is uniformly charged by the charger 312. When the uniformly charged photoreceptor drum 311 is scanned by the laser beams, an electrostatic latent image is formed on the surface of each photoreceptor drum 311.

The electrostatic latent image is developed by each developer 314, and toner images of Y, M, C, K colors are formed on the surface of each photoreceptor drum 311. At a primary transfer position, the toner images are sequentially transferred to the intermediate transfer belt 315 rotated in an arrow direction by electrostatic power acted by each primary transfer roller 315. At this time, the image forming operation for each color is executed at different timings in a sequence of Y, M, C, K so that the toner images are superimposed on the same position on the intermediate transfer belt 321.

Meanwhile, the sheet is fed from the fed paper conveyor 330 via the timing roller pair 334 at the timing of transport by the intermediate transfer belt 321. The toner images on the intermediate transfer belt 321 are secondarily transferred to the sheet by electrostatic power acted by the secondary transfer roller 335 at the secondary transfer position. The sheet that has passed the secondarily transfer position is conveyed to the fixer 340. After the toner images on the sheet (unfixed images) are fixed to a first face of the sheet by the fixer 340 by heat and pressure, the sheet is ejected to the output tray 337 via the output roller pair 336.

The printer controller 350 is a computer system composed of CPU, a ROM storing therein an operating program and the like, a nonvolatile memory storing therein variable data, storage and the like. The printer controller 350 controls functions and operation of the entire copying machine 1 by controlling each unit. Thus, the copying machine 1 is able to perform processing, such as a print job and the like.

The control panel 10 is arranged at a maneuverable position on the copying machine 1. On the control panel 10, there arranged a numeric keypad for designating the number of copies, and keys for switching document reading modes of switching between the one-face and the both-face reading modes, between a high-definition and a low-definition reading mode, and such. A user can select each mode by pressing the keys.

Furthermore, the control panel 10 has an "open/close" key for automatically opening and closing the device body 110. In response to the "open/close" key pressed by a user while the device body 110 is closed, the control panel 10 outputs operating information for promoting opening of the device body 110 to the open/close instructor 179. In addition, when the "open/close" key is pressed by a user while the device body 110 is open, the control panel 10 outputs operating information for promoting closing of the device body 110 to the open/close instructor 179.

[Operation of Automatic Document Feeder Device and Image Forming Device]

Subsequently, a description is made on operation of the copying machine 1 in accordance with an embodiment of the present invention. The copying machine 1 of the embodiment is characterized by operation of automatically opening and closing the device body 110 of the ADF unit 100, particularly by the operation (opening operation) for opening the device body 110 in response to the user's operation of pressing the "open/close" key. Since other operations are basically identical with those performed by a heretofore-known copying machine, solely the opening operation is described here.

Embodiment 1

When a detection result of the detectors 130 and 140 satisfies a predetermined condition, the open/close controller 172 of the ADF unit 100 in accordance with Embodiment 1 restrains the driver from applying driving force to the hinge connectors 150. Specifically, the predetermined condition is satisfied when a document is present in at least one of the trays 111 and 112.

Figure 5:
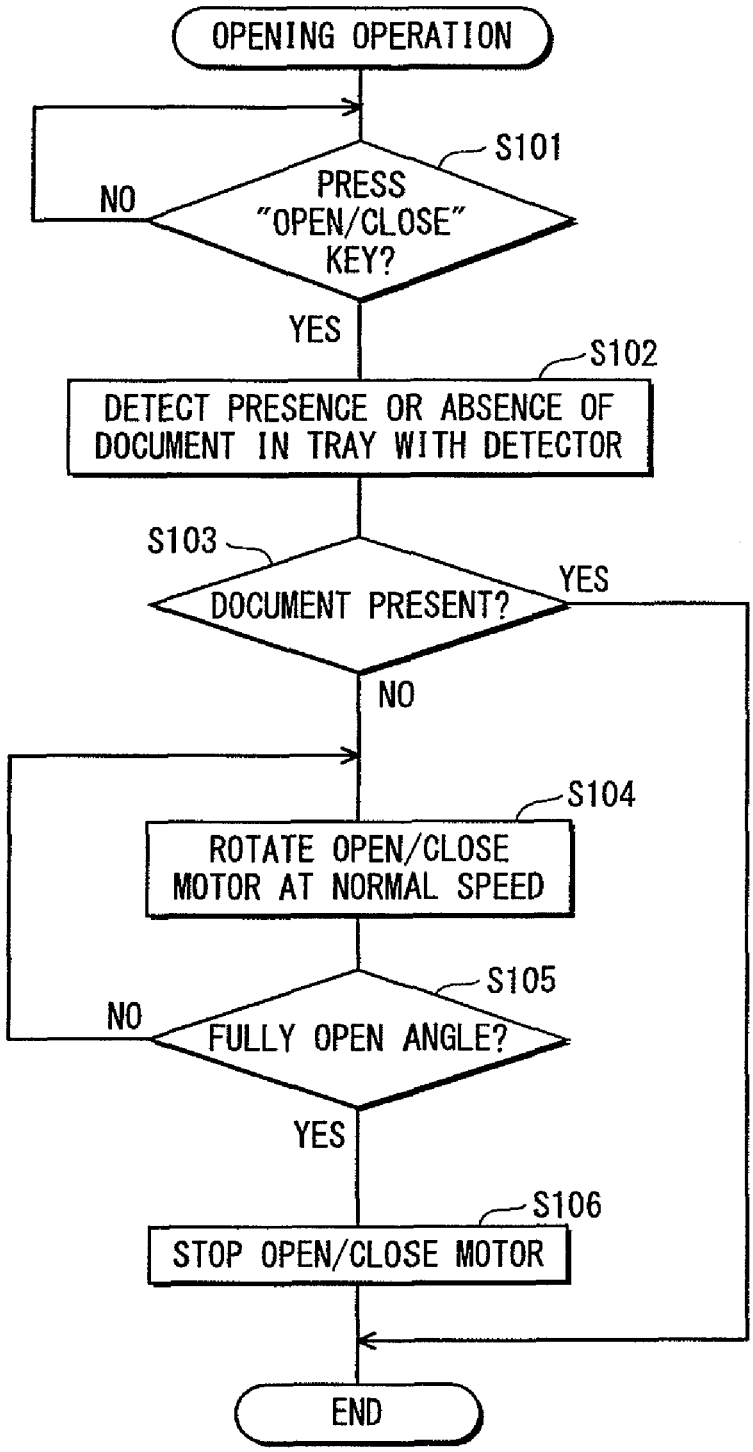
FIG. 5 is a flowchart showing processing contents of opening operation in accordance with Embodiment 1 of the present invention.

As shown in FIG. 5, the "open/close" key of the control panel 10 is pressed by a user ("YES" in Step S101), and the operating information for promoting the opening operation is outputted from the control panel 10 to the ADF•CPU 171. In response, the detectors 130 and 140 respectively detect whether or not a document is present in trays 111 and 112 (Step S102).

The open/close controller 172 judges whether a document is present according to the detection result (Step S103). When either of the detectors 130 and 140 detects a document, the open/close controller 172 judges that a document is present at least in one of the trays 111 and 112 ("YES" in Step S103). When neither of the detectors 130 and 140 detects a document, the open/close controller 172 judges that a document is absent in the tray 111 or 112 ("NO" in Step S103).

Figure 6A:
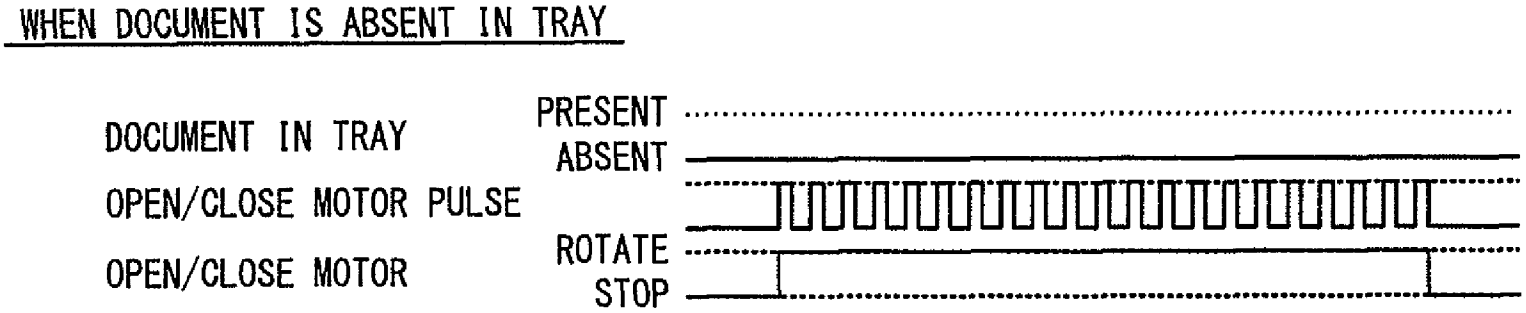
FIG. 6A shows when documents are absent in a feeder tray.

When the open/close controller 172 judges that a document is absent in the tray 111 and 112 ("NO" in Step S103), the open/close controller 172 controls the driver 160 to rotate the open/close motor 161 at a normal speed (Step S104). Accordingly, the device body 110 starts to be opened at the normal speed. When the device body 110 reaches a fully-open position (a position that makes an angle relative to the device body fully open) ("YES" in Step S105), the open/close controller 172 stops the rotation of the open/close motor 161 (Step S106), and stops the device body 110 at the fully-open position. In this instance, as shown in FIG. 6A, until the device body 110 reaches the fully-open position, the open/close controller 172 performs control such that the open/close motor 161 is rotated at a motor pulse enabling the device body 110 to be opened at the normal speed.

Figure 6B:
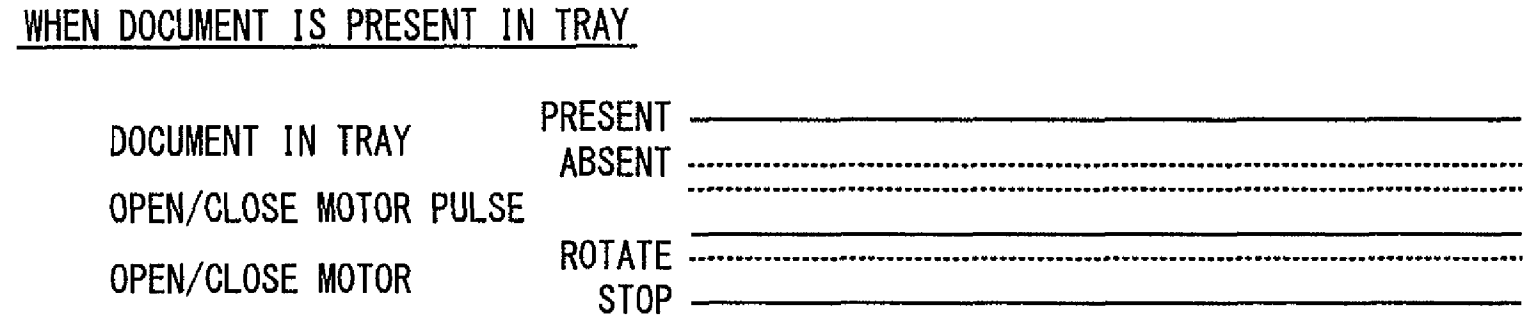
FIG. 6B shows when documents are present in the feeder tray.

On the other hand, returning to Step S103, when the open/close controller 172 jueges that a document is present at least on one of the trays 111 and 112 ("YES" in Step S103), the open/close controller 172 completes the opening operation, without having the open/close motor 161 rotated at all. That is to say, the device body 110 remains closed. In this instance, as shown in FIG. 6B, the open/close controller 172 does not drive to rotate the open/close motor 161 at all. As a consequent, since the device body 110 is not at all opened, the document in the trays 111 and 112 is prevented from falling off.

Embodiment 2

The open/close controller 172 of the ADF unit 100 in accordance with Embodiment 2 performs processing to fully open the device body 110 when a document is absent in either of the trays 111 and 112, and not to fully open the device body 110 when a document is present in the trays 111 and 112.

Figure 7:
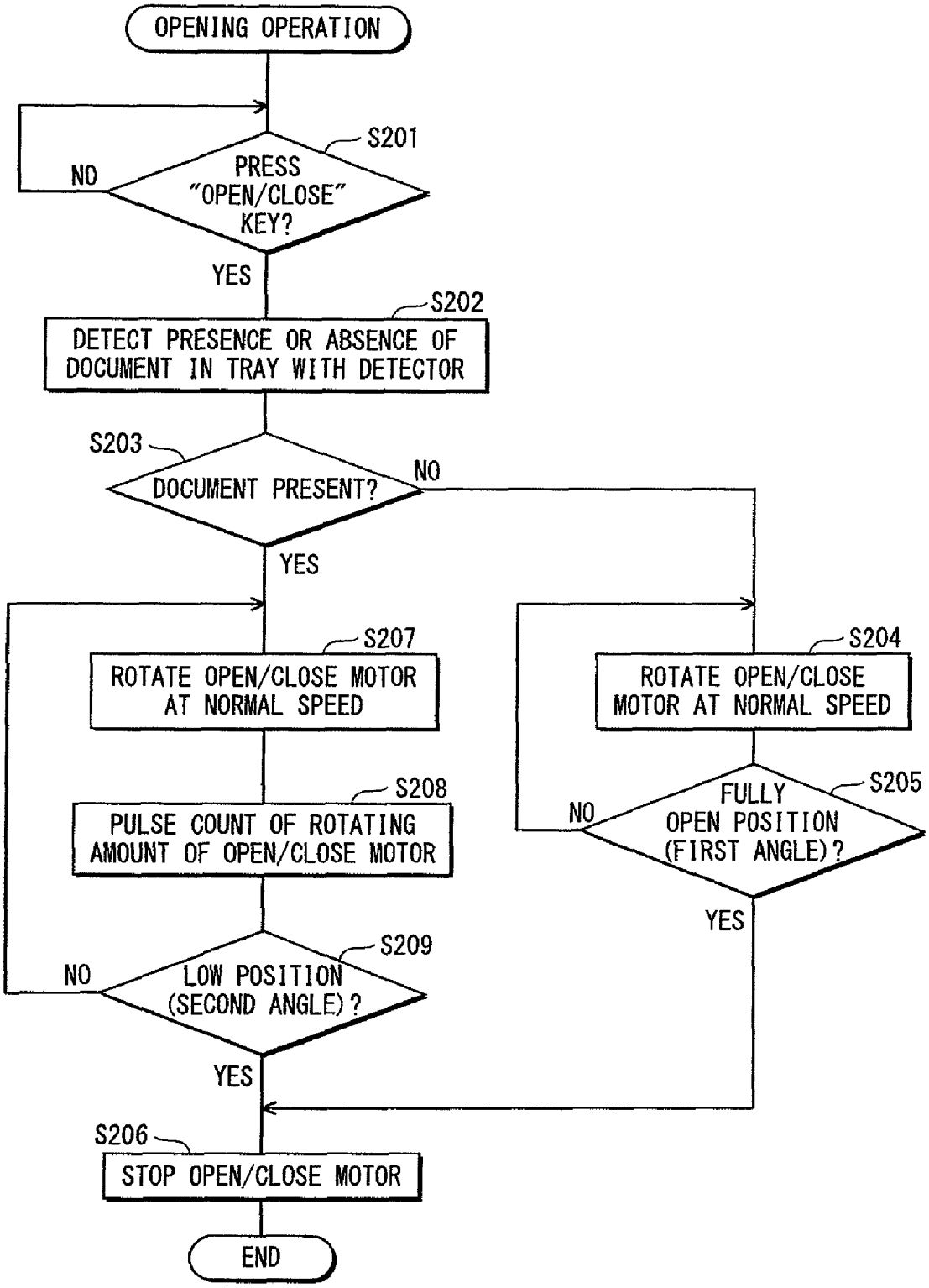
FIG. 7 is a flowchart showing processing contents of opening operation in accordance with Embodiment 2 of the present invention.

As shown in FIG. 7, the "open/close" key of the control panel 10 is pressed by a user ("YES" in Step S201), and the operating information for promoting the opening operation is outputted from the control panel 10 to the ADF•CPU 171. In response, the detectors 130 and 140 detect whether or not a document is present in trays 111 and 112 (Step S202).

The open/close controller 172 judges whether a document is present according to the detection result (Step S203). When either of the detectors 130 and 140 detects a document, the open/close controller 172 judges that the document is present at least on one of the trays 111 and 112 ("YES" in Step S203). When neither of the detectors 130 and 140 detects a document, the open/close controller 172 judges that the document is absent in the tray 111 or 112 ("NO" in Step S203).

Figure 8A:
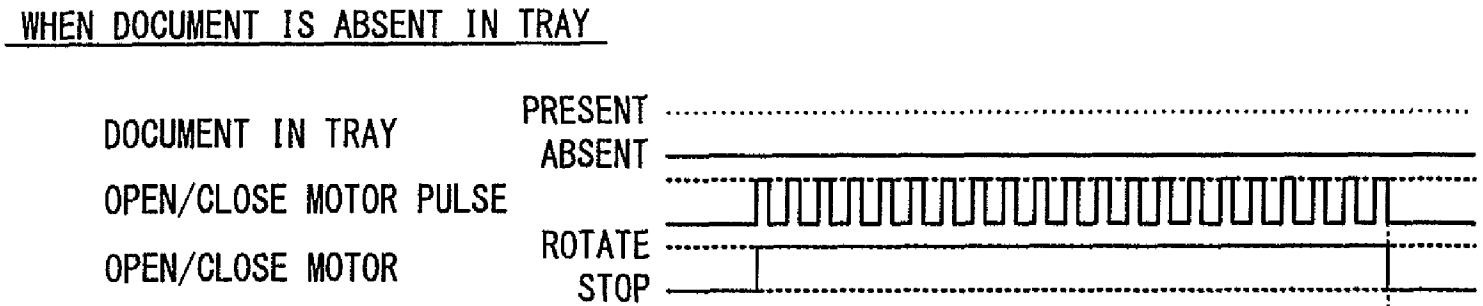
FIG. 8A shows when documents are absent in the feeder tray.

When the open/close controller 172 judges that a document is absent in either of the trays 111 and 112 ("NO" in Step S203), the open/close controller 172 performs Steps S204-S206 that are identical with hereinbefore-mentioned Steps S104-106. In this instance, as shown in FIG. 8A, until the device body 110 reaches the fully-open position (a position at which the opening angle with respect to the device body 110 becomes a first angle), the open/close controller 172 controls the driver 160 to drive the open/close motor 161 to be rotated at a motor pulse enabling the device body 110 to be opened at the normal speed.

Figure 8B:
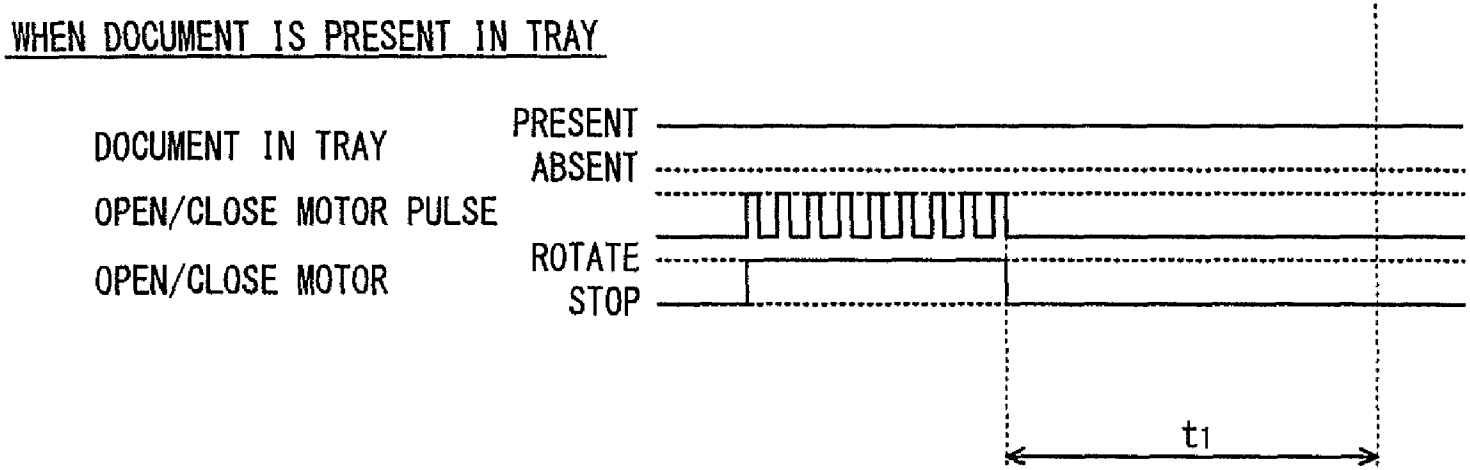
FIG. 8B shows when documents are present in the feeder tray.

On the other hand, returning to Step S203, when judging that a document is present in at least one of the trays 111 and 112 ("YES" in Step S203), the open/close controller 172 controls the driver 160 to drive the open/close motor 161 to be rotated at the normal speed (Step S207). Accordingly, the device body 110 starts to be opened at the normal speed. When the open/close motor 161 starts to be rotated, the open/close controller 172 keeps pulse count of a rotating amount of the open/close motor 161 (Step S208). Subsequently, when the device body 110 reaches a low position (second angle) ("YES" in Step S209), the open/close controller 172 stops the rotation of the open/close motor 161 (Step S206). Note that the second angle that makes the device body at the low position is smaller than the first angle that makes the device body 110 fully open. The second angle is preset to an angle at which documents stacked on the trays 111 and 112 are unlikely to fall off. In this instance, as shown in FIG. 8B, although the open/close controller 172 performs control such that the open/close motor 161 is rotated at a motor pulse enabling the device body 110 to be opened at the normal speed, rotation time thereof is shorter by t1 than time necessary for the device body 110 to reach the fully-open position. Accordingly, the device body 110 does not reach the fully-open position, which prevents documents in the tray 111 or 112 from falling off.

Embodiment 3

When a document is absent in either of the trays 111 and 112, the open/close controller 172 of the ADF unit 100 in accordance with Embodiment 3 performs processing to fully open the device body 110 at the normal speed (first speed). When a document is present in the trays 111 and 112, the open/close controller 172 of Embodiment 3 moves the device body 110 at a lower speed (second speed) than the normal speed and not fully open the device body 110.

Figure 9:
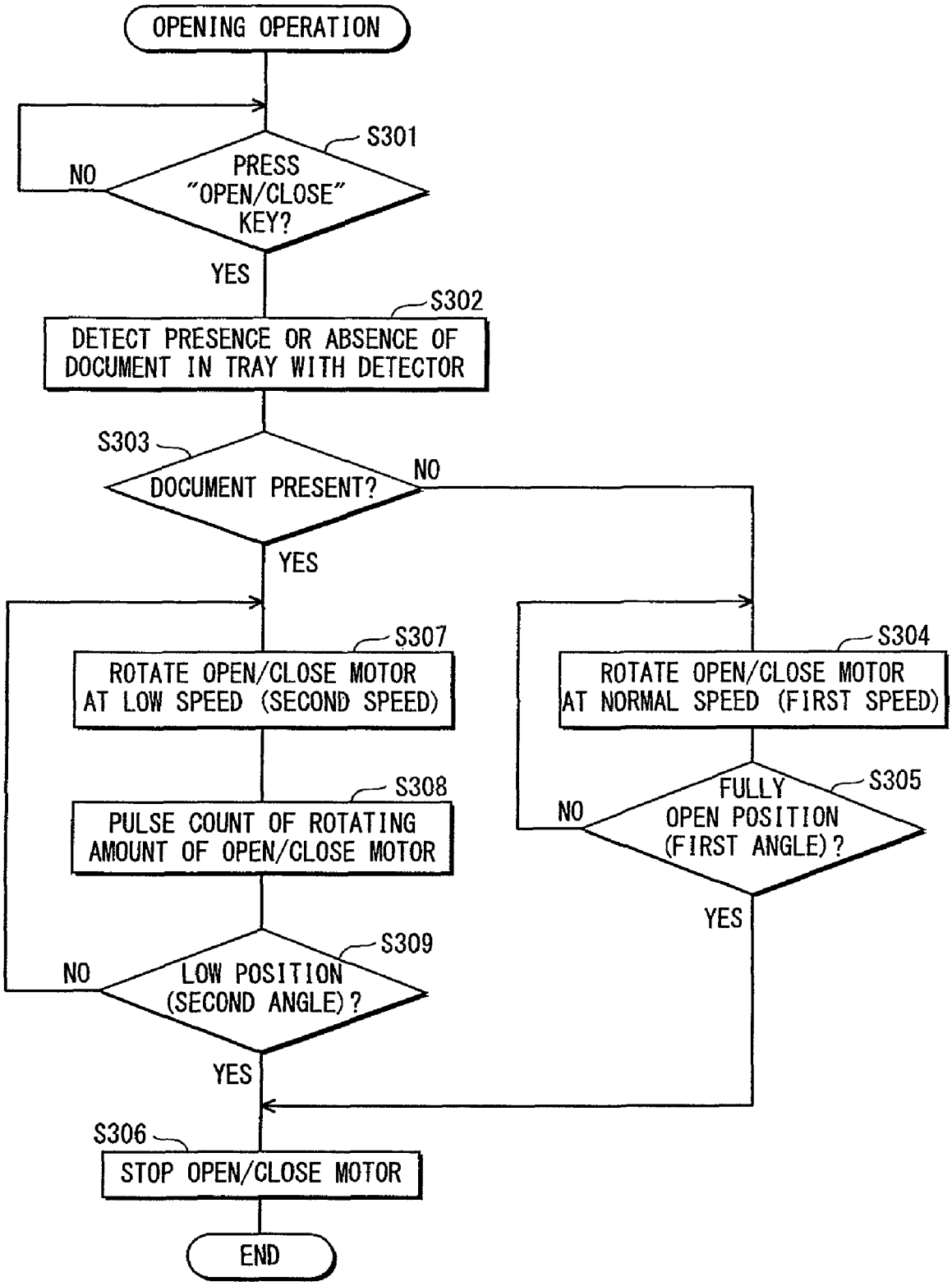
FIG. 9 is a flowchart showing processing contents of opening operation in accordance with Embodiment 3 of the present invention.

As shown in FIG. 9, the "open/close" key of the control panel 10 is pressed by a user ("YES" in Step S301), and the operating information for promoting the opening operation is outputted from the control panel 10 to the ADF•CPU 171. In response, the detectors 130 and 140 detect whether or not a document is present in trays 111 and 112 (Step S302).

The open/close controller 172 judges whether a document is present according to the detection result (Step S303). When either of the detectors 130 and 140 detects a document, the open/close controller judges that a document is present at least on one of the trays 111 and 112 ("YES" in Step S303). When neither of the detectors 130 and 140 detects a document, the open/close controller 172 judges that a document is absent in the tray 111 or 112 ("NO" in Step S301).

Figures 10A, 10B:
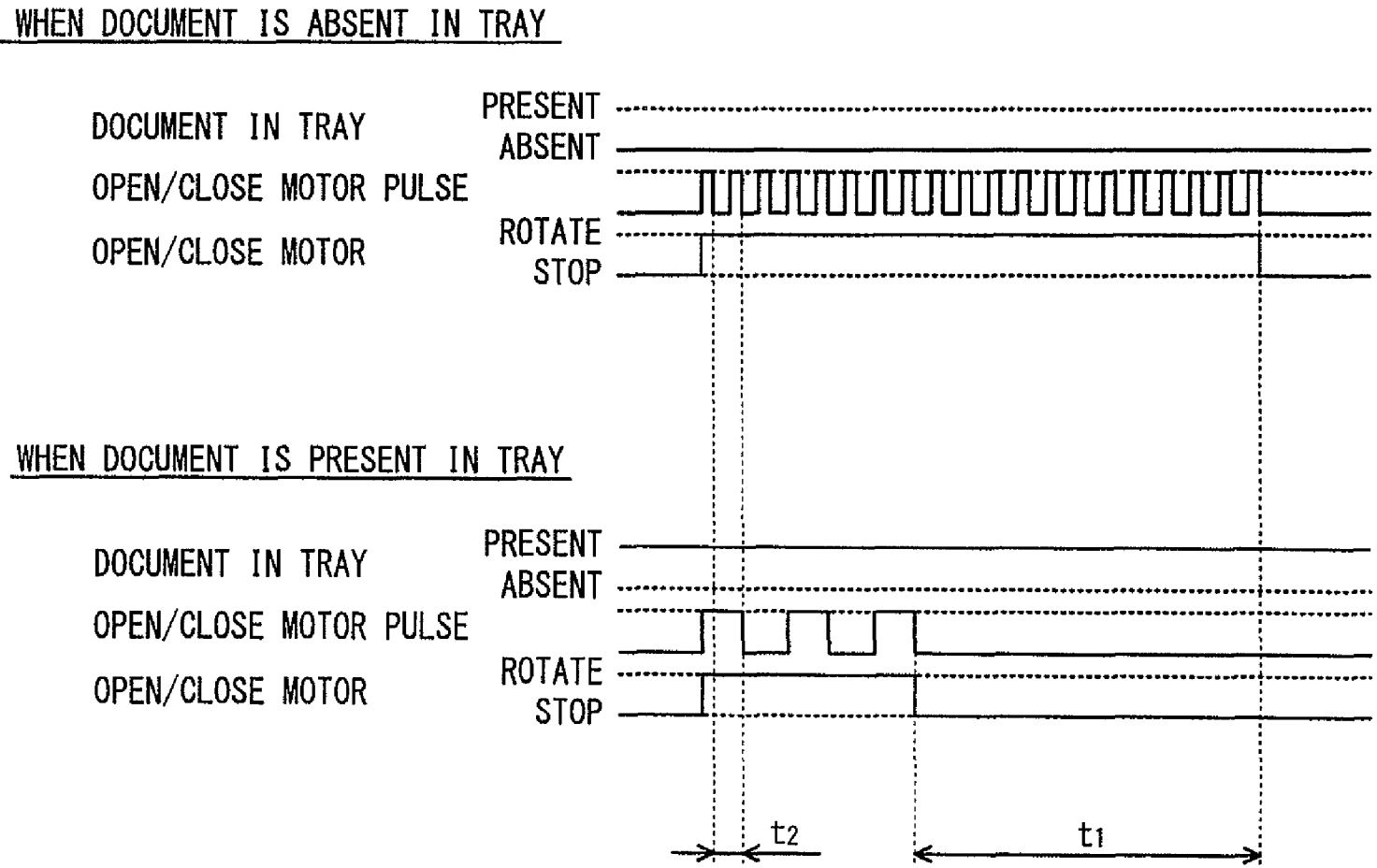
FIG. 10A shows when documents are absent in the feeder tray.
FIG. 10B shows when documents are present in the feeder tray.

When judging that a document is absent in either of the trays 111 and 112 ("NO" in Step S303), the open/close controller 172 performs Steps S304-S306 that are identical with hereinbefore-mentioned Steps S104-106. In this instance, as shown in FIG. 10A, until the device body 110 reaches the fully-open position (a position at which the opening angle with respect to the device body 110 becomes the first angle), the open/close controller 172 performs control such that the open/close motor 161 is rotated at a motor pulse enabling the device body 110 to be opened at the normal speed.

On the other hand, returning to Step S303, when judging that a document is present in at least one of the trays 111 and 112 ("YES" in Step S303), the open/close controller 172 controls the driver 160 to drive the open/close motor 161 to be rotated at a low speed (Step S307). Note that the low speed is lower than the normal speed, and is preset to a speed that is unlikely to cause documents stacked on the trays 111 and 112 to fall off. Accordingly, the device body 110 starts to be opened at the normal speed. When the open/close motor 161 starts to be rotated, the open/close controller 172 keeps pulse count of a rotating amount of the open/close motor 161 (Step S308). Subsequently, when the device body 110 reaches the low position (second angle) ("YES" in Step S309), the open/close controller 172 stops the rotation of the open/close motor 161 (Step S306). Note that the second angle that makes the device body at the low position is smaller than the first angle that makes the device body 110 fully open. The second angle is preset to an angle that is unlikely to cause documents stacked on the trays 111 and 112 to fall off. In this instance, as shown in FIG. 10B, although the open/close controller 172 performs control such that the open/close motor 161 is rotated at a motor pulse whose pulse width (half cycle width) is larger by t2 than a motor pulse enabling the device body 110 to be opened at the normal speed, rotation time thereof is shorter by t1 than time necessary for the device body 110 to reach the fully-open position. Accordingly, the device body 110 is opened at a lower speed than the normal speed, and furthermore does not reach the fully-open position, which prevents documents in the tray 111 or 112 from falling off.

Embodiment 4

Figures 11, 12:
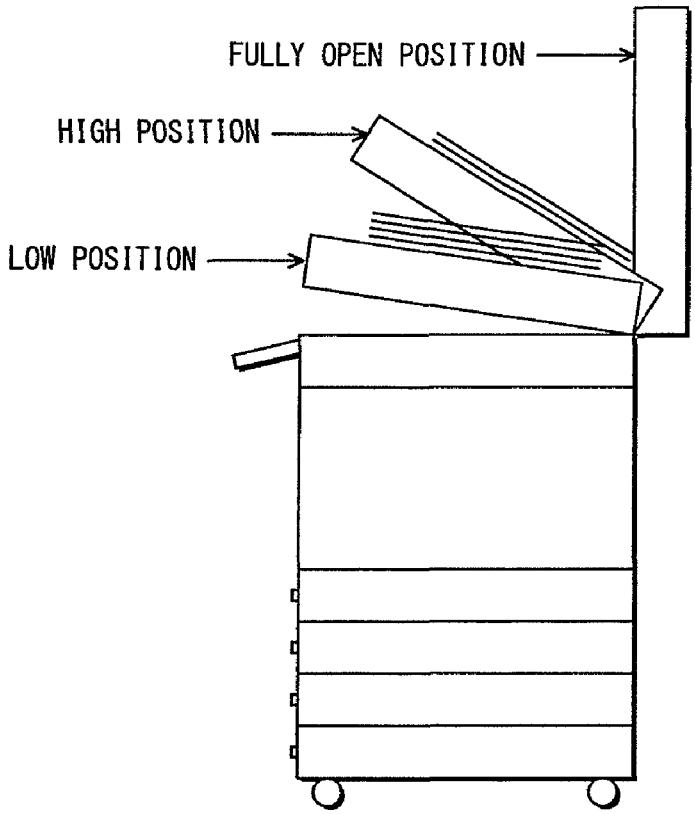
FIG. 11 is a diagram showing a content of an opening information table in accordance with Embodiment 4 of the present invention.
FIG. 12 is a conceptual diagram showing the opening operation in accordance with Embodiment 4 of the present invention.

As shown in FIG. 11, the open/close controller 172 of the ADF unit 100 in accordance with Embodiment 4 controls the opening operation of the device body 110 as follows. When a document is absent in either of the trays 111 and 112, the open/close controller 172 controls the opening operation such that the device body 110 reaches the fully-open position (first angle) shown in FIG. 12. When a small amount of documents is present in the trays 111 and 112, the open/close controller 172 controls the opening operation such that the device body 110 reaches a high position (second angle) shown in FIG. 12. When a large amount of documents is present in the trays 111 and 112, the open/close controller 172 controls the opening operation such that the device body 110 reaches merely the low position (third angle) shown in FIG. 12.

More specifically, the detectors 130 and 140 detect presence or absence and an amount of documents stacked on the trays 111 and 112 as the document-stack state.

When judging that a document is absent in either of the trays 111 and 112, the open/close controller 172 controls the driver 160 such that the device body 110 reaches the fully-open position at the normal speed. In other words, until the opening angle with respect to the device body 110 becomes the first angle, the open/close controller 172 performs control such that the open/close motor 161 is rotated at a motor pulse enabling the device body 110 to be opened at the normal speed.

In addition, when judging that a document is present in at least one of the trays 111 and 112 and that an amount is smaller than a criterion, the open/close controller 172 controls the driver 160 to drive the open/close motor 161 to reach the high position. In other words, until the opening angle with respect to the device body 110 becomes the second angle that is smaller than the first angle, the open/close controller 172 performs control such that the open/close motor 161 is rotated at a motor pulse enabling the device body 110 to be opened at the normal speed. Note that the criterion of an amount of documents stacked on the trays 111 and 112 is preset to an amount that is unlikely to cause the fall of the documents at the high position (second angle).

When judging that a document is present in at least one of the trays 111 and 112 and that an amount is equal to or larger than the criterion, the open/close controller 172 controls the driver 160 to drive the device body 110 to reach the low position at the normal speed. In other words, until the opening angle with respect to the device body 110 becomes the third angle that is smaller than the second angle, the open/close controller 172 performs control such that the open/close motor 161 is rotated at a motor pulse enabling the device body 110 to be opened at the normal speed.

Such control over the opening operation prevents documents in the trays 111 and 112 from falling off.

In the above case, when a document is present in each of the trays 111 and 112, a target tray that has an amount of documents equal to or larger than the criterion is determined by the following processing. Based on FIG. 13, a description is made.

Figures 13, 14:
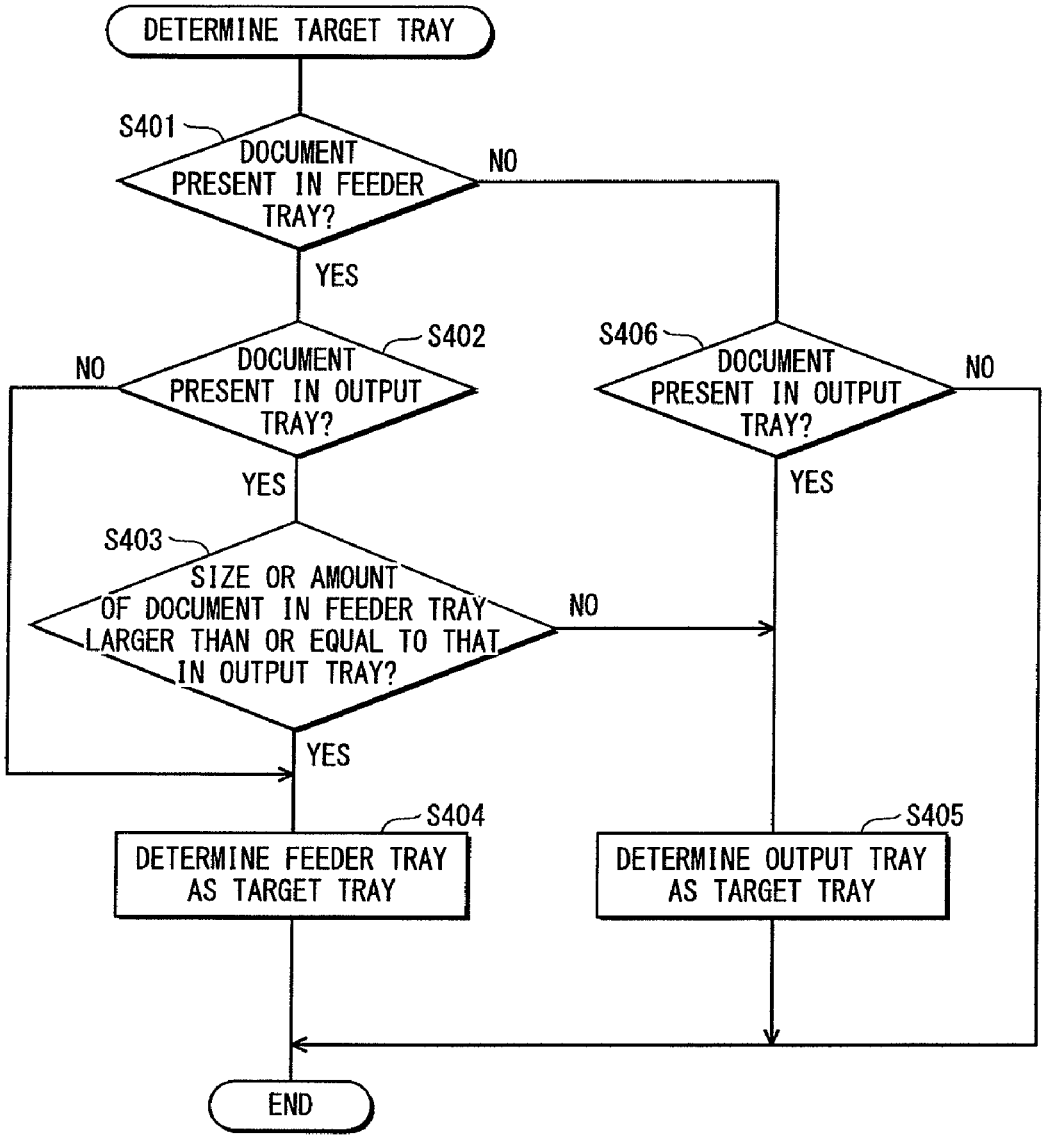
FIG. 13 is a flowchart showing a processing content to determine a target tray that has an amount of documents equal to or larger than a criterion.
FIG. 14 is a diagram showing a content of an opening information table in accordance with Embodiment 5 of the present invention.

As shown in FIG. 13, firstly, the open/close controller 172 judges whether a document is present in the feeder tray 111 (Step S401), and further judges whether a document is present in the output tray 112 (Step S402). When a document is present in the feeder tray 111 ("YES" is Step S401), and when a document is also present in the output tray 112 ("YES" in Step S402), documents are present in both trays 111 and 112.

When documents are present in both trays 111 and 112, subsequently, the open/close controller 172 judges whether an amount of documents in the tray 111 is larger than that in the output tray 112 (Step S403). When an amount of the documents in the feeder tray 111 is equal to or larger than that in the output tray 112 ("YES" in Step S403), it is determined that the feeder tray 111 is the target tray having an amount of documents judged to be equal to or larger than the criterion (Step S404). On the other hand, when an amount of documents in the tray 111 is smaller ("NO" in Step S403), it is determined that the output tray 112 is the target tray having an amount of documents judged to be equal to or larger than the criterion (Step S405).

Note that when a document is present only in the feeder tray 111, which is to say, when a document is present in the feeder tray 111 ("YES" in Step S401), and absent in the output tray 112 ("NO" in Step S402), needless to say, the feeder tray 111 is determined as the target tray. In addition, when a document is present only in the output tray 112, which is to say, when a document is absent in the feeder tray 111 ("NO" in Step S401), and present in the output tray 112 ("YES" in Step S406), needless to say, the output tray 112 is determined as the target tray. In addition, when a document is absent in the feeder tray 111 ("NO" in Step S401), and when a document is also absent in the output tray 112 ("NO" in Step S406), the processing is completed without determining the target tray.

In determining a target tray having documents whose size is equal to or larger than the criterion, the processing basically identical with the above is also performed except for the processing of Step S403 of judging whether or not a size of documents in the feeder tray 111 is larger.

Embodiment 5

As shown in FIG. 14, the open/close controller 172 of the ADF unit 100 in accordance with Embodiment 5 controls the opening operation of the device body 110 as follows. When a document is absent in either of the trays 111 and 112, the open/close controller 172 controls the opening operation such that the device body 110 reaches the fully-open position (first angle) shown in FIG. 15. When small-sized documents are present in the trays 111 and 112, the open/close controller 172 controls the opening operation such that the device body 110 reaches the high position (second angle) shown in FIG. 15. When large-sized documents are present in the trays 111 and 112, the open/close controller 172 controls the opening operation such that the device body 110 reaches merely the low position (third angle) shown in FIG. 15.

More specifically, the detectors 130 and 140 detect presence or absence and a size of documents stacked on the trays 111 and 112 as the document-stack state.

When judging that a document is absent in either of the trays 111 and 112, the open/close controller 172 controls the driver 160 such that the device body 110 reaches the fully-open position at the normal speed. In other words, until the opening angle with respect to the device body 110 becomes the first angle, the open/close controller 172 performs control such that the open/close motor 161 is rotated at a motor pulse enabling the device body 110 to be opened at the normal speed.

In addition, when judging that a document is present in at least one of the trays 111 and 112 and that a size is smaller than the criterion, the open/close controller 172 controls the driver 160 to drive the open/close motor 161 to reach the high position at the normal speed. In other words, until the opening angle with respect to the device body 110 becomes the second angle that is smaller than the first angle, the open/close controller 172 performs control such that the open/close motor 161 is rotated at a motor pulse enabling the device body 110 to be opened at the normal speed. Note that the criterion of a size of documents stacked on the trays 111 and 112 is preset to a size that is unlikely to cause the fall of the documents at the high position (second angle).

When judging that a document is present in at least one of the trays 111 and 112 and that a size is equal to or larger than the criterion, the open/close controller 172 controls the driver 160 to drive the device body 110 to reach the low position at the normal speed. In other words, until the opening angle with respect to the device body 110 becomes the third angle that is smaller than the second angle, the open/close controller 172 performs control such that the open/close motor 161 is rotated at a motor pulse enabling the device body 110 to be opened at the normal speed.

Such control over the opening operation prevents documents in the trays 111 and 112 from falling off.

Embodiment 6

Figures 15, 16:
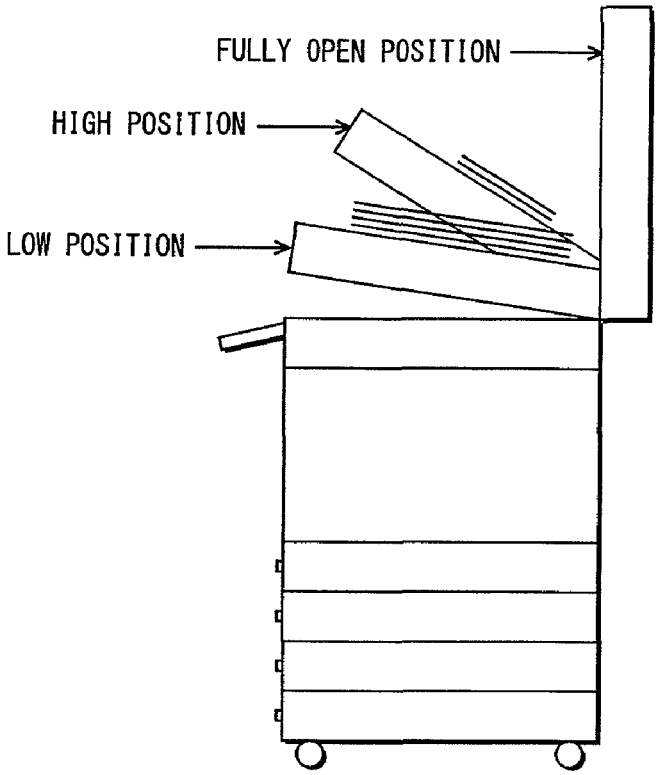
FIG. 15 is a conceptual diagram showing opening operation in accordance with Embodiment 5 of the present invention.
FIG. 16 is a diagram showing a content of an opening information table in accordance with Embodiment 6 of the present invention.

As shown in FIG. 16, the open/close controller 172 of the ADF unit 100 in accordance with Embodiment 6 controls the opening operation of the device body 110 as follows. When a document is absent in either of the trays 111 and 112, the open/close controller 172 controls the opening operation such that the device body 110 reaches the fully-open position (first angle) shown in FIG. 17. When a small amount of small-sized documents are present in the trays 111 and 112, the open/close controller 172 controls the opening operation such that the device body 110 reaches the high position (second angle) shown in FIG. 17. When a large amount of small-sized documents or a small mount of large-sized documents are present in the trays 111 and 112, the open/close controller 172 controls the opening operation such that the device body 110 reaches a medium position (third angle) shown in FIG. 17. When a large amount of large-sized documents are present in the trays 111 and 112, the open/close controller 172 controls the opening operation such that the device body 110 reaches the low position (fourth angle) shown in FIG. 17.

More specifically, the detectors 130 and 140 detect presence or absence, an amount and a size of documents stacked on the trays 111 and 112 as the document-stack state.

When judging that a document is absent in either of the trays 111 and 112, the open/close controller 172 controls the driver 160 such that the device body 110 reaches the fully-open position at the normal speed. In other words, until the opening angle with respect to the device body 110 becomes the first angle, the open/close controller 172 performs control such that the open/close motor 161 is rotated at a motor pulse enabling the device body 110 to be opened at the normal speed.

In addition, when judging that a document is present in at least one of the trays 111 and 112 and that an amount and a size are smaller than the respective criteria, the open/close controller 172 controls the driver 160 to drive the open/close motor 161 to reach the high position at the normal speed. In other words, until the opening angle with respect to the device body 110 becomes the second angle that is smaller than the first angle, the open/close controller 172 performs control such that the open/close motor 161 is rotated at a motor pulse enabling the device body 110 to be opened at the normal speed. Note that the criteria of a size and an amount of documents stacked on the trays 111 and 112 are preset to a size and an amount that are unlikely to cause the fall of the documents at the high position (second angle).

In addition, when judging that a document is present in at least one of the trays 111 and 112 and that an amount is equal to or larger than the criterion and a size is smaller than the criterion, the open/close controller 172 controls the driver 160 to drive the device body 110 to reach the medium position at the normal speed. In other words, until the opening angle with respect to the device body 110 becomes the third angle that is smaller than the second angle, the open/close controller 172 performs control such that the open/close motor 161 is rotated at a motor pulse enabling the device body 110 to be opened at the normal speed.

In addition, when judging that a document is present in at least one of the trays 111 and 112 and that an amount is smaller than the criterion and a size is equal to or larger than the criterion, the open/close controller 172 controls the driver 160 to drive the device body 110 to reach the medium position at the normal speed. In other words, until the opening angle with respect to the device body 110 becomes the third angle, the open/close controller 172 performs control such that the open/close motor 161 is rotated at a motor pulse enabling the device body 110 to be opened at the normal speed.

In addition, when judging that a document is present in at least one of the trays 111 and 112 and that an amount and a size are equal to or larger than the respective criteria, the open/close controller 172 controls the driver 160 to drive the device body 110 to reach the low position at the normal speed. In other words, until the opening angle with respect to the device body 110 becomes the fourth angle that is smaller than the third angle, the open/close controller 172 performs control such that the open/close motor 161 is rotated at a motor pulse enabling the device body 110 to be opened at the normal speed.

Such control over the opening operation prevents documents in the trays 111 and 112 from falling off.

Embodiment 7

Figures 17, 18:
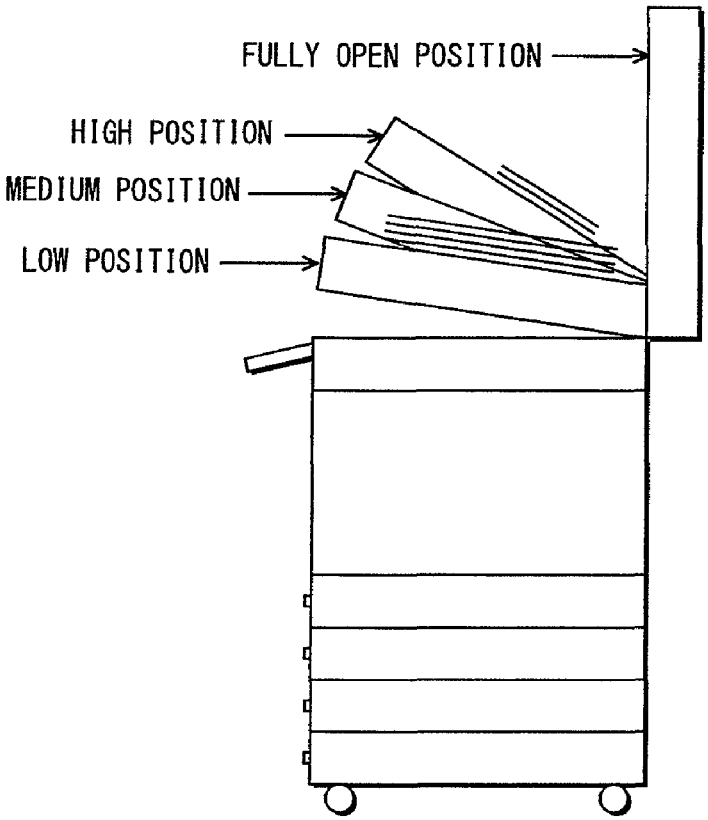
FIG. 17 is a conceptual diagram showing opening operation in accordance with Embodiment 6 of the present invention.
FIG. 18 is a diagram showing a content of an opening information table in accordance with Embodiment 7 of the present invention.

As shown in FIG. 18, the open/close controller 172 of the ADF unit 100 in accordance with Embodiment 7 controls the opening operation of the device body 110 as follows. When a document is absent in either of the trays 111 and 112, the open/close controller 172 controls the opening operation such that the device body 110 reaches the fully-open position at an ultrahigh speed (first speed). When a small amount of documents are present in the trays 111 and 112, the open/close controller 172 controls the opening operation such that the device body 110 reaches the fully-open position at the high speed (second speed). When a large amount of documents are present in the trays 111 and 112, the open/close controller 172 controls the opening operation such that the device body 110 reaches the fully-open position at the low speed (third speed).

More specifically, the detectors 130 and 140 detect presence or absence and an amount of documents stacked on the trays 111 and 112 as the document-stack state.

Figure 19A:
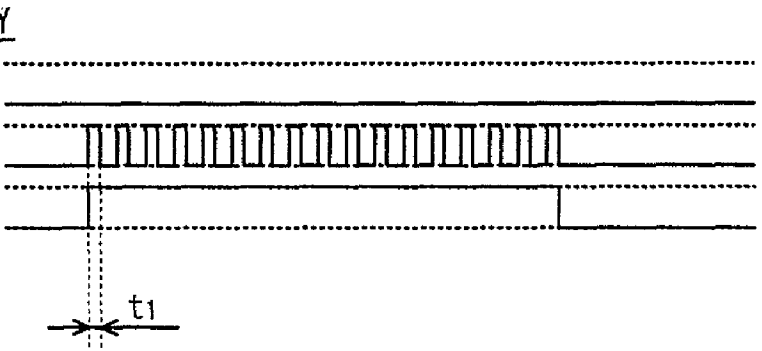
FIG. 19A shows when documents are absent in the feeder tray.

When judging that a document is absent in either of the trays 111 and 112, the open/close controller 172 controls the driver 160 such that the device body 110 reaches the fully-open position at the ultrahigh speed. In other words, as shown in FIG. 19A, until the device body 110 reaches the fully-open position, the open/close controller 172 performs control such that the open/close motor 161 is rotated at a motor pulse (pulse width t1) enabling the device body 110 to be opened at the ultrahigh speed.

Figure 19B:
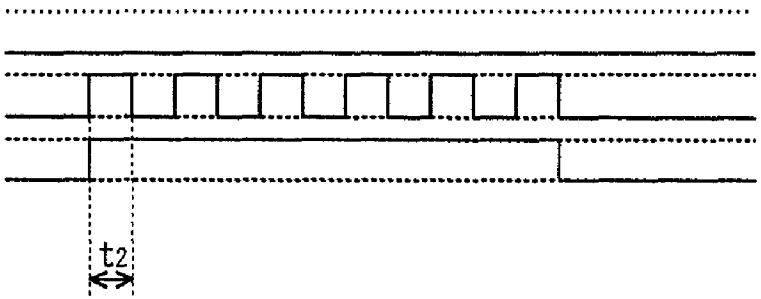
FIG. 19B shows when a small amount of documents are present in the feeder tray.

In addition, when judging that a document is present in at least one of the trays 111 and 112 and that an amount is smaller than the criterion, the open/close controller 172 controls the driver 160 to drive the open/close motor 161 to reach the fully-open position at a high speed lower than the ultrahigh speed. In other words, as shown in FIG. 19B, until the device body 110 reaches the fully-open position, the open/close controller 172 performs control such that the open/close motor 161 is rotated at a motor pulse (pulse width t2 that is larger than the pulse width t1) enabling the device body 110 to be opened at the high speed. Note that the criterion of an amount of documents stacked on the trays 111 and 112 is preset to an amount that is unlikely to cause the fall of the documents at the high speed (second speed).

Figure 19C:
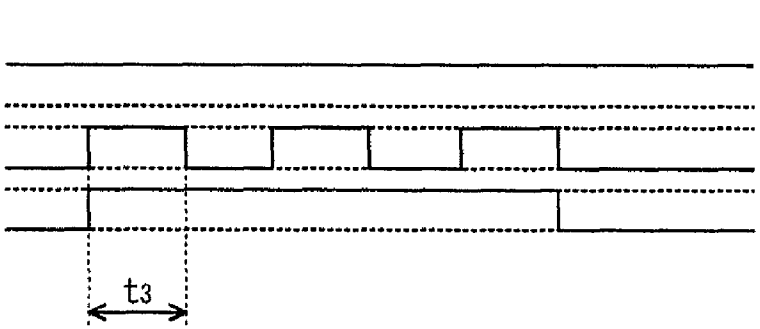
FIG. 19C shows when a large amount of documents are present in the feeder tray.

When judging that a document is present in at least one of the trays 111 and 112 and that an amount is equal to or larger than the criterion, the open/close controller 172 controls the driver 160 such that the device body 110 reaches the fully-open position at the low speed that is lower than the high speed. In other words, as shown in FIG. 19C, until the device body 110 reaches the fully-open position, the open/close controller 172 performs control such that the open/close motor 161 is rotated at a motor pulse (pulse width t3 that is larger than the pulse width t2) enabling the device body 110 to be opened at the low speed.

Such control over the opening operation prevents documents in the trays 111 and 112 from falling off.

Embodiment 8

As shown in FIG. 20, the open/close controller 172 of the ADF unit 100 in accordance with Embodiment 8 controls the opening operation of the device body 110 as follows. When a document is absent in either of the trays 111 and 112, the open/close controller 172 controls the opening operation such that the device body 110 reaches the fully-open position at the ultrahigh speed (first speed). When small-sized documents are present in the trays 111 and 112, the open/close controller 172 controls the opening operation such that the device body 110 reaches the fully-open position at the high speed (second speed). When large-sized documents are present in the trays 111 and 112, the open/close controller 172 controls the opening operation such that the device body 110 reaches the fully-open position at the low speed (third speed).

More specifically, the detectors 130 and 140 detect presence or absence and a size of documents stacked on the trays 111 and 112 as the document-stack state.

Figure 21A:
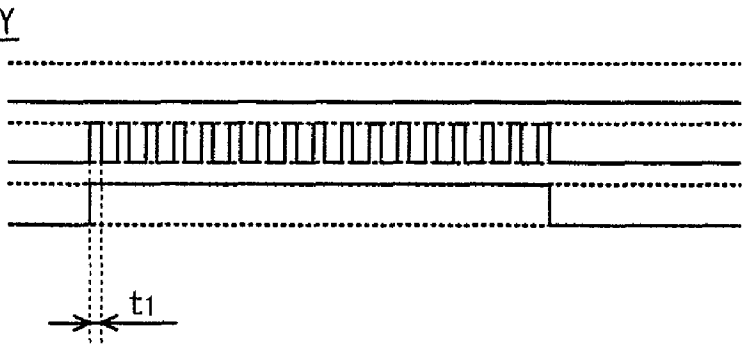
FIG. 21A shows when documents are absent in the feeder tray.

When judging that a document is absent in either of the trays 111 and 112, the open/close controller 172 controls the driver 160 such that the device body 110 reaches the fully-open position at the ultrahigh speed. In other words, as shown in FIG. 21A, until the device body 110 reaches the fully-open position, the open/close controller 172 performs control such that the open/close motor 161 is rotated at a motor pulse (pulse width t1) enabling the device body 110 to be opened at the ultrahigh speed.

Figure 21B:
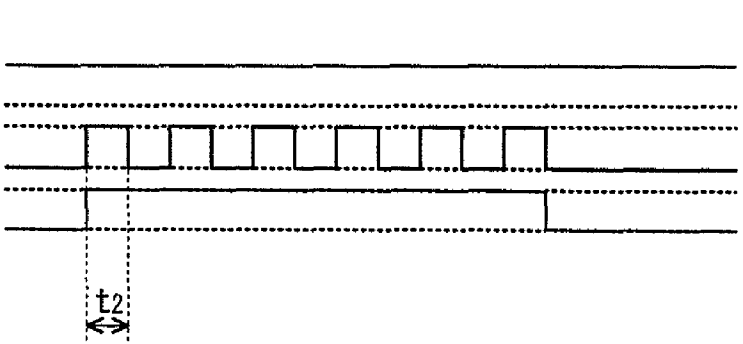
FIG. 21B shows when small-sized documents are present in the feeder tray.

In addition, when judging that a document is present in at least one of the trays 111 and 112 and that a size is smaller than the criterion, the open/close controller 172 controls the driver 160 to drive the open/close motor 161 to reach the fully-open position at the high speed lower than the ultrahigh speed. In other words, as shown in FIG. 21B, until the device body 110 reaches the fully-open position, the open/close controller 172 performs control such that the open/close motor 161 is rotated at a motor pulse (pulse width t2 that is larger than the pulse width t1) enabling the device body 110 to be opened at the high speed. Note that the criterion of a size of documents stacked on the trays 111 and 112 is preset to a size that is unlikely to cause the fall of the documents at the high speed (second speed).

Figure 21C:
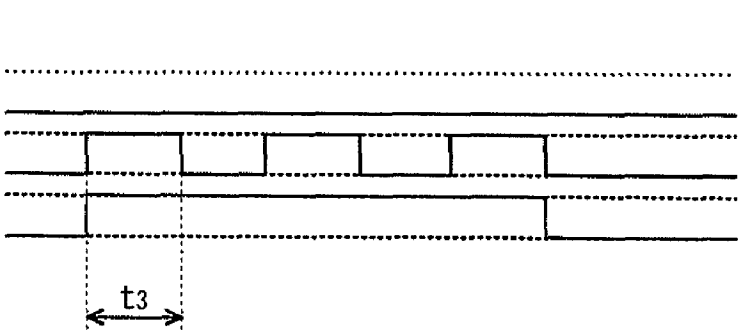
FIG. 21C shows when large-sized documents are present in the feeder tray.

In addition, when judging that a document is present in at least one of the trays 111 and 112 and that a size is equal to or larger than the criterion, the open/close controller 172 controls the driver 160 such that the device body 110 reaches the fully-open position at the low speed that is lower than the high speed. In other words, as shown in FIG. 21C, until the device body 110 reaches the fully-open position, the open/close controller 172 performs control such that the open/close motor 161 is rotated at a motor pulse (pulse width t3 that is larger than the pulse width t2) enabling the device body 110 to be opened at the low speed.

Such control over the opening operation prevents documents in the trays 111 and 112 from falling off.

Embodiment 9

As shown in FIG. 22, the open/close controller 172 of the ADF unit 100 in accordance with Embodiment 9 controls the opening operation of the device body 110 as follows. When a document is absent in either of the trays 111 and 112, the open/close controller 172 controls the opening operation such that the device body 110 reaches the fully-open position at the ultrahigh speed. When a small amount of small-sized documents are present in the trays 111 and 112, the open/close controller 172 controls the opening operation such that the device body 110 reaches the fully-open position at the high speed. When a small amount of large-sized documents are present in the trays 111 and 112, the open/close controller 172 controls the opening operation such that the device body 110 reaches the fully-open position at a medium speed. When a large amount of small-sized documents are present in the trays 111 and 112, the open/close controller 172 controls the opening operation such that the device body 110 reaches the fully-open position at the medium speed. When a large amount of large-sized documents are present in the trays 111 and 112, the open/close controller 172 controls the opening operation such that the device body 110 reaches the fully-open position at the low speed.

More specifically, the detectors 130 and 140 detect presence or absence, an amount and a size of documents stacked on the trays 111 and 112 as the document-stack state.

When judging that a document is absent in either of the trays 111 and 112, the open/close controller 172 controls the driver 160 such that the device body 110 reaches the fully-open position at the ultrahigh speed. In other words, as shown in FIG. 23A, until the device body 110 reaches the fully-open position, the open/close controller 172 performs control such that the open/close motor 161 is rotated at a motor pulse (pulse width t1) enabling the device body 110 to be opened at the ultrahigh speed.

In addition, when judging that a document is present in at least one of the trays 111 and 112 and that an amount and a size are smaller than the respective criteria, the open/close controller 172 controls the driver 160 to drive the open/close motor 161 such that the device body 110 reaches the fully-open position at the high speed lower than the ultrahigh speed. In other words, as shown in FIG. 23B, until the device body 110 reaches the fully-open position, the open/close controller 172 performs control such that the open/close motor 161 is rotated at a motor pulse (pulse width t2 that is larger than the pulse width t1) enabling the device body 110 to be opened at the high speed. Note that the criteria of an amount and a size of documents stacked on the trays 111 and 112 are preset to an amount and a size that are unlikely to cause the fall of the documents at the high speed.

In addition, when judging that a document is present in at least one of the trays 111 and 112 and that an amount is equal to or larger than the criterion and a size is smaller than the criterion. In other words, as shown in FIG. 23C, until the device body 110 reaches the fully-open position, the open/close controller 172 performs control such that the open/close motor 161 is rotated at a motor pulse (pulse width t3 that is larger than the pulse width t2) enabling the device body 110 to be opened at the medium speed.

In addition, when judging that a document is present in at least one of the trays 111 and 112 and that an amount is smaller than the criterion and a size is equal to or larger than the criterion, the open/close controller 172 performs the same processing as with when judging that a document is present in at least one of the trays 111 and 112, that an amount is equal to or larger than criterion and that a size is smaller than the criterion.

In addition, when judging that a document is present in at least one of the trays 111 and 112 and that an amount and an size are equal to or larger than the respective criteria, the open/close controller 172 controls the driver 160 such that the device body 110 reaches the fully-open position at the low speed that is lower than the medium speed. In other words, as shown in FIG. 23D, until the device body 110 reaches the fully open position, the open/close controller 172 performs control such that the open/close motor 161 is rotated at a motor pulse (pulse width t4 that is larger than the pulse width t3) enabling the device body 110 to be opened at the low speed.

Such control over the opening operation prevents documents in the trays 111 and 112 from falling off.

Embodiment 10

As shown in FIG. 24, the open/close controller 172 of the ADF unit 100 in accordance with Embodiment 10 controls the opening operation of the device body 110 as follows. When a document is absent in either of the trays 111 and 112, the open/close controller 172 controls the opening operation such that the device body 110 reaches the fully-open position (position that makes the opening angle with respect to the device body 110 be the first angle) at the ultrahigh speed (first speed). When a small amount of documents are present in the trays 111 and 112, the open/close controller 172 controls the opening operation such that the device body 110 reaches the high position (position that makes the device body 110 be the second angle smaller than the first angle) at the high speed (second speed). When a large amount of documents are present in the trays 111 and 112, the open/close controller 172 controls the opening operation such that the device body 110 reaches the low position (position that makes the device body 110 be the third angle smaller than the second angle) at the low speed (third speed).

More specifically, the detectors 130 and 140 detect presence or absence, and an amount of documents stacked on the trays 111 and 112 as the document-stack state.

Figure 25A:
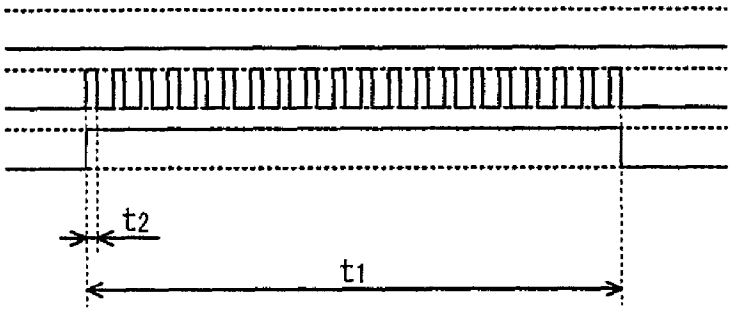
FIG. 25A shows when documents are absent in the feeder tray.

When judging that a document is absent in either of the trays 111 and 112, the open/close controller 172 controls the driver 160 such that the device body 110 reaches the fully-open position at the ultrahigh speed. In other words, as shown in FIG. 25A, until the device body 110 reaches the fully-open position (time t1), the open/close controller 172 performs control such that the open/close motor 161 is rotated at a motor pulse (pulse width t2) enabling the device body 110 to be opened at the ultrahigh speed.

Figure 25B:
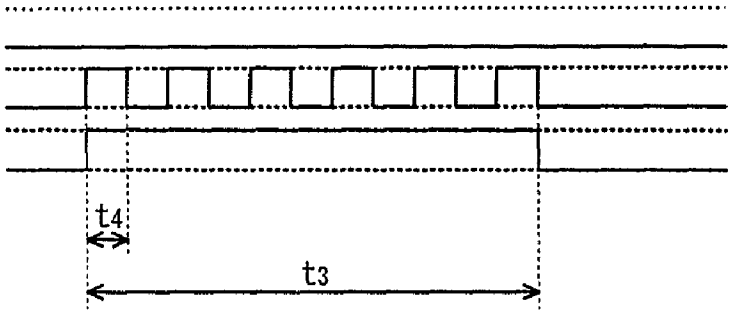
FIG. 25B shows when a small amount of documents are present in the feeder tray.

In addition, when judging that a document is present in at least one of the trays 111 and 112 and that an amount is smaller than the criterion, the open/close controller 172 controls the driver 160 to drive the open/close motor 161 to reach the high position at the high speed lower than the ultrahigh speed. In other words, as shown in FIG. 25B, until the device body 110 reaches the high position (time t3 shorter than the time t1), the open/close controller 172 performs control such that the open/close motor 161 is rotated at a motor pulse (pulse width t4 that is larger than the pulse width t2) enabling the device body 110 to be opened at the high speed. Note that the criterion of an amount of documents stacked on the trays 111 and 112 is preset to an amount that is unlikely to cause the fall of the documents at the high position (second angle) and the high speed (second speed).

Figure 25C:
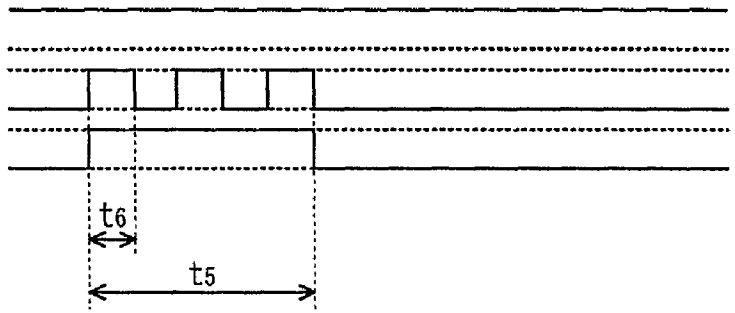
FIG. 25C shows when a large amount documents are present in the feeder tray.

In addition, when judging that a document is present in at least one of the trays 111 and 112 and that an amount is equal to or larger than the criterion, the open/close controller 172 controls the opening operation such that the device body 110 reaches the low position at the low speed lower than the high speed. In other words, as shown in FIG. 25C, until the device body 110 reaches the low position (time t5 shorter than the time t3), the open/close controller 172 performs control such that the open/close motor 161 is rotated at a motor pulse (pulse width t6 that is larger than the pulse width t4) enabling the device body 110 to be opened at the low speed.

Such control over the opening operation prevents documents in the trays 111 and 112 from falling off.

Embodiment 11

As shown in FIG. 26, the open/close controller 172 of the ADF unit 100 in accordance with Embodiment 11 controls the opening operation of the device body 110 as follows. When a document is absent in either of the trays 111 and 112, the open/close controller 172 controls the opening operation such that the device body 110 reaches the fully-open position (position that makes the opening angle with respect to the device body 110 be the first angle) at the ultrahigh speed (first speed). When small-sized documents are present in the trays 111 and 112, the open/close controller 172 controls the opening operation such that the device body 110 reaches the high position (position that makes the device body 110 be the second angle smaller than the first angle) at the high speed (second speed). When large-sized documents are present in the trays 111 and 112, the open/close controller 172 controls the opening operation such that the device body 110 reaches the low position (position that makes the device body 110 be the third angle smaller than the second angle) at the low speed (third speed).

More specifically, the detectors 130 and 140 detect presence or absence, and a size of documents stacked on the trays 111 and 112 as the document-stack state.

Figure 27A:
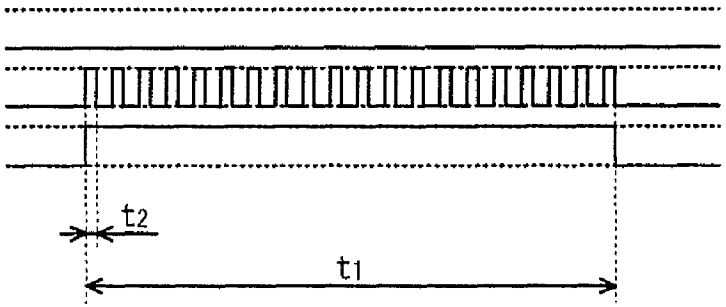
FIG. 27A shows when documents are absent in the feeder tray.

When judging that a document is absent in either of the trays 111 and 112, the open/close controller 172 controls the driver 160 such that the device body 110 reaches the fully-open position at the ultrahigh speed. In other words, as shown in FIG. 27A, until the device body 110 reaches the fully-open position (time t1), the open/close controller 172 performs control such that the open/close motor 161 is rotated at a motor pulse (pulse width t1) enabling the device body 110 to be opened at the ultrahigh speed.

Figure 27B:
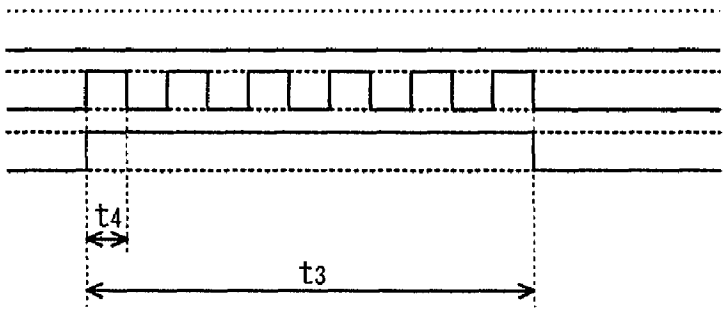
FIG. 27B shows when small-sized documents are present in the feeder tray.

In addition, when judging that a document is present in at least one of the trays 111 and 112 and that a size is smaller than the criterion, the open/close controller 172 controls the driver 160 to drive the open/close motor 161 to reach the high position at the high speed lower than the ultrahigh speed. In other words, as shown in FIG. 27B, until the device body 110 reaches the high position (time t3 shorter than the time t1), the open/close controller 172 performs control such that the open/close motor 161 is rotated at a motor pulse (pulse width t4 that is larger than the pulse width t2) enabling the device body 110 to be opened at the high speed. Note that the criterion of a size of documents stacked on the trays 111 and 112 is preset to a size that is unlikely to cause the fall of the documents at the high position (second angle) and the high speed (second speed).

Figure 27C:
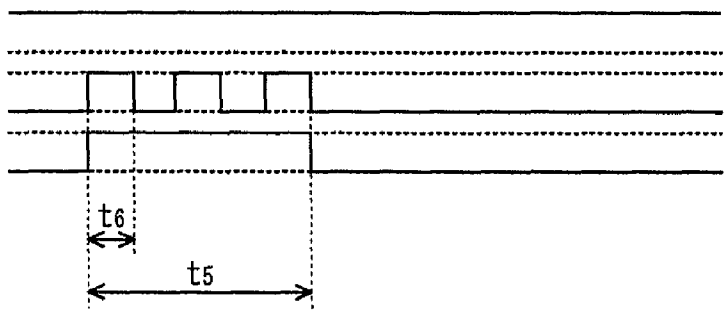
FIG. 27C shows when large-sized documents are present in the feeder tray.

In addition, when judging that a document is present in at least one of the trays 111 and 112 and that a size is equal to or larger than the criterion, the open/close controller 172 controls the opening operation such that the device body 110 reaches the low position at the low speed lower than the high speed. In other words, as shown in FIG. 27C, until the device body 110 reaches the low position (time t5 shorter than the time t3), the open/close controller 172 performs control such that the open/close motor 161 is rotated at a motor pulse (pulse width t6 that is larger than the pulse width t4) enabling the device body 110 to be opened at the low speed.

Such control over the opening operation prevents documents in the trays 111 and 112 from falling off.

Embodiment 12

As shown in FIG. 28, the open/close controller 172 of the ADF unit 100 in accordance with Embodiment 12 controls the opening operation of the device body 110 as follows. When a document is absent in either of the trays 111 and 112, the open/close controller 172 controls the opening operation such that the device body 110 reaches the fully-open position (position that makes the opening angle with respect to the device body 110 be the first angle) at the ultrahigh speed. When a small amount of small-sized documents are present in the trays 111 and 112, the open/close controller 172 controls the opening operation such that the device body 110 reaches the high position (position that makes the device body 110 be the second angle smaller than the first angle) at the high speed. When a small amount of large-sized documents are present in the trays 111 and 112, the open/close controller 172 controls the opening operation such that the device body 110 reaches the medium position (position that makes the device body 110 be the third angle smaller than the second angle) at the medium speed. When a large amount of small-sized documents are present in the trays 111 and 112, the open/close controller 172 controls the opening operation such that the device body 110 reaches the medium position at the medium speed. When a large amount of large-sized documents are present in the trays 111 and 112, the open/close controller 172 controls the opening operation such that the device body 110 reaches the low position (position that makes the device body 110 be the fourth angle smaller than the third angle) at the low speed.

More specifically, the detectors 130 and 140 detect presence or absence, and a size of documents stacked on the trays 111 and 112 as the document-stack state.

Figures 29A, 29B, 29C, 29D:
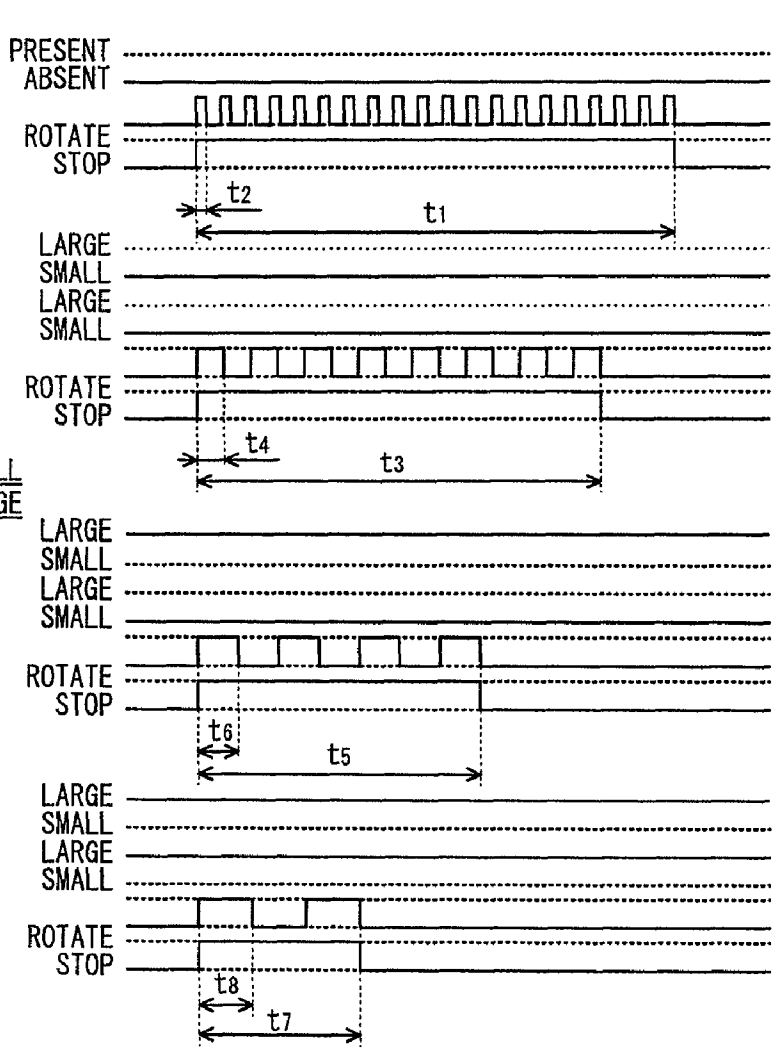
FIG. 29A shows when documents are absent in the feeder tray.
FIG. 29B shows when a small amount of small-sized documents are present in the feeder tray.
FIG. 29C shows when a large amount of small-sized documents are present in the feeder tray, and when a small amount of large-sized documents are present in the feeder tray.
FIG. 29D shows when a large amount of large-sized documents are present in the feeder tray.

When judging that a document is absent in either of the trays 111 and 112, the open/close controller 172 controls the driver 160 such that the device body 110 reaches the fully-open position at the ultrahigh speed. In other words, as shown in FIG. 29A, until the device body 110 reaches the fully-open position (time t1), the open/close controller 172 performs control such that the open/close motor 161 is rotated at a motor pulse (pulse width t2) enabling the device body 110 to be opened at the ultrahigh speed.

In addition, when judging that a document is present in at least one of the trays 111 and 112 and that an amount and size are smaller that the respective criteria, the open/close controller 172 controls the driver 160 to drive the open/close motor 161 to reach the high position at the high speed lower than the ultrahigh speed. In other words, as shown in FIG. 29B, until the device body 110 reaches the high position (time t3 shorter than the time t1), the open/close controller 172 performs control such that the open/close motor 161 is rotated at a motor pulse (pulse width t4 that is larger than the pulse width t2) enabling the device body 110 to be opened at the high speed. Note that the criteria of an amount and a size of documents stacked on the trays 111 and 112 are preset to an amount and a size that are unlikely to cause the fall of the documents at the high position (second angle) and the high speed.

In addition, when judging that a document is present in at least one of the trays 111 and 112 and that an amount is equal to or larger than the criterion and a size is smaller than the criterion, the open/close controller 172 controls the opening operation such that the device body 110 reaches the medium position at the medium speed lower than the high speed. In other words, as shown in FIG. 29C, until the device body 110 reaches the medium position (time t5 shorter than the time t3), the open/close controller 172 performs control such that the open/close motor 161 is rotated at a motor pulse (pulse width t6 that is larger than the pulse width t4) enabling the device body 110 to be opened at the medium speed.

In addition, when judging that a document is present in at least one of the trays 111 and 112 and that an amount is smaller than the criterion and a size is equal to or larger than the criterion, the open/close controller 172 performs the same processing as with when judging that a document is present in at least one of the trays 111 and 112 and that an amount is equal to or larger than criterion and a size is smaller than the criterion.

In addition, when judging that a document is present in at least one of the trays 111 and 112 and that an amount and a size are equal to or larger than the respective criteria, the open/close controller 172 controls the opening operation such that the device body 110 reaches the low position at the low speed lower than the medium speed. In other words, as shown in FIG. 29D, until the device body 110 reaches the low position (time t7 shorter than the time t5), the open/close controller 172 performs control such that the open/close motor 161 is rotated at a motor pulse (pulse width t8 that is larger than the pulse width t6) enabling the device body 110 to be opened at the low speed.

Such control over the opening operation prevents documents in the trays 111 and 112 from falling off.

<Modification>

Hereinbefore, the present invention is described based on the embodiments, however, the present invention is never limited to these. For example, the image forming device is not limited to a copying machine, and may be a multifunction peripheral having, for example, a facsimile function.

In addition, according to the image forming device of the embodiments, the document-stack states of both of the feeder tray and the output tray are detected. However, a detector may be arranged on either one of the trays, and the detector may detect the document-stack state of one of the trays. In addition, when either one of the feeder tray and the output tray is not fixed to the device body of the automatic document feeder device thereby not being pivoted in conjunction with the device body, or when documents in one of the trays are likely to fall off due to configuration and structural features thereof, a detector may be arranged only on another tray which is pivoted with the device body or on the tray which is more likely to drop documents. Based on a detection result of the detector, the controller may restrain the driver from driving the device body or control an amount of the driving.

In addition, the detector is satisfactory as long as the detector can detect the document-stack state of the tray. Although a plurality of detectors are arranged on the feeder tray and/or the output tray to detect the document-stack state on the tray on which the detectors are arranged in the above embodiments, at least part of the detectors may be arranged on other parts than the trays so as to detect states of the trays.

INDUSTRIAL APPLICABILITY

The present invention is widely applicable to an image forming device, such as a printer, a copying machine, a facsimile machine, a multifunction peripheral and the like.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An automatic document feeder device having a device body disposed on a platen of a document reading device, the device body being pivotably openable relative to the document reading device by being hingedly connected thereto, the automatic document feeder device comprising:

a detector operable to detect a document-stack state of a document on at least one of a feeder tray and an output tray provided on the device body, the document-stack state indicates (a) presence or absence, (b) an amount or (c) a size of documents stacked on the feeder tray or the output tray;

a driver operable to drive the device body to be pivotably opened in an upward direction from the platen;

an instructor operable to give an instruction such that the driver drives the device body; and a controller operable to (i) suppress the driving of the device body or (ii) control an amount of the driving based on a detection result of the detector in priority to the instruction, the controller controls the driving amount by adjusting at least one of an opening angle and an opening speed of the device body, according to the document-stack state.

2. The automatic document feeder device of claim 1, wherein the document-stack state indicates presence or absence of documents stacked on the feeder tray or the output tray, the controller permits the driver to drive the device body when a document is absent, and forbids the driver to drive the device body when a document is present.

3. The automatic document feeder device of claim 1, wherein the controller controls the driving amount such that (i) when a document is absent, an opening angle is a first angle, (ii) when a document is present and when the amount is smaller than a criterion, the opening angle is a second angle that is smaller than the first angle, and (iii) when a document is present and when the amount is equal to the criterion or larger, the opening angle is a third angle that is smaller than the second angle.

4. The automatic document feeder device of claim 1, wherein the controller controls the driving amount such that (i) when a document is absent, an opening angle is a first angle, (ii) when a document is present and when the size is smaller than a criterion, the opening angle is a second angle that is smaller than the first angle, and (iii) when a document is present and when the size is equal to the criterion or larger, the opening angle is a third angle that is smaller than the second angle.

5. The automatic document feeder device of claim 1, wherein the controller controls the driving amount such that (i) when a document is absent, an opening angle is a first angle, (ii) when a document is present, and when the size and the amount are smaller than respective criteria, the opening angle is a second angle that is smaller than the first angle, (iii) when a document is present, (a) when the amount is equal to the criterion or larger, and when the size is smaller than the criterion, or (b) when the amount is smaller than the criterion, and when the size is equal to the criterion or larger, the opening angle is a third angle that is smaller than the second angle, and (iv) when a document is present, and when the size and the amount are equal to the respective criteria or larger, the opening angle is a fourth angle that is smaller than the third angle.

6. The automatic document feeder device of claim 1, wherein the controller controls the driving amount such that (i) when a document is absent, an opening speed is a first speed, (ii) when a document is present and when the amount is smaller than a criterion, the opening speed is a second speed that is lower than the first speed, and (iii) when a document is present and when the amount is equal to the criterion or larger, the opening speed is a third speed that is lower than the second speed.

7. The automatic document feeder device of claim 1, wherein the controller controls the driving amount such that (i) when a document is absent, an opening speed is a first speed, (ii) when a document is present and when the size is smaller than a criterion, the opening speed is a second speed that is lower than the first speed, and (iii) when a document is present and when the size is equal to the criterion or larger, the opening speed is a third speed that is lower than the second speed.

8. The automatic document feeder device of claim 1, wherein the controller controls the driving amount such that (i) when a document is absent, an opening speed is a first speed, (ii) when a document is present, and when the amount and the size are smaller than respective criteria, the opening speed is a second speed that is lower than the first speed, (iii) when a document is present, (a) when the amount is equal to the criterion or larger, and when the size is smaller than the criterion, or (b) when the amount is smaller than the criterion, and when the size is equal to the criterion or larger, the opening speed is a third speed that is lower than the second speed, and (iv) when a document is present, and when the size and the amount are equal to the respective criteria or larger, the opening speed is a fourth speed that is lower than the third speed.

9. The automatic document feeder device of claim 1, wherein the controller controls the driving amount such that (i) when a document is absent, an opening angle is a first angle, and an opening speed is a first speed, (ii) when a document is present, and when the amount is smaller than a criterion, the opening angle is a second angle that is smaller than the first angle, and the opening speed is a second speed that is lower than the first speed, and (iii) when a document is present, and when the amount is equal to the criterion or larger, the opening angle is a third angle that is smaller than the second angle, and the opening speed is a third speed that is lower than the second speed.

10. The automatic document feeder device of claim 1, wherein the controller controls the driving amount such that (i) when a document is absent, an opening angle is a first angle and an opening speed is a first speed, (ii) when a document is present, and when the size is smaller than a criterion, the opening angle is a second angle that is smaller than the first angle, and the opening speed is a second speed that is lower than the first speed, and (iii) when a document is present, and when the size is equal to the criterion or larger, the opening angle is a third angle that is smaller than the second angle, and the opening speed is a third speed that is lower than the second speed.

11. The automatic document feeder device of claim 1, wherein the controller controls the driving amount such that (i) when a document is absent, an opening angle is a first angle and an opening speed is a first speed, (ii) when a document is present, and when the amount and the size are smaller than respective criteria, the opening angle is a second angle that is smaller than the first angle, and the opening speed is a second speed that is lower than the first speed, (iii) when a document is present, (a) when the amount is equal to the criterion or larger, and when the size is smaller than the criterion, or (b) when the amount is smaller than the criterion, and when the size is equal to the criterion or larger, the opening angle is a third angle that is smaller than the second angle, and the opening speed is a third speed that is lower than the second speed, and (iv) when a document is present, and when the amount and the size are equal to the respective criteria or larger, the opening angle is a fourth angle that is smaller than the third angle, and the opening speed is a fourth speed that is lower than the third speed.

12. An image forming device that includes an automatic document feeder device having a device body disposed on a platen of a document reading device, the device body being pivotably openable relative to the document reading device by being hingedly connected thereto, the image forming device comprising:

a detector operable to detect a document-stack state of a document on at least one of a feeder tray and an output tray provided on the device body, the document-stack state indicates (a) presence or absence, (b) an amount or (c) a size of documents stacked on the feeder tray or the output tray;

a driver operable to drive the device body to be pivotably opened in an upward direction from the platen;

an instructor operable to give an instruction such that the driver drives the device body; and a controller operable to (i) suppress the driving of the device body or (ii) control an amount of the driving based on a detection result of the detector in priority to the instruction, the controller controls the driving amount by adjusting at least one of an opening angle and an opening speed of the device body, according to the document-stack state.

* * * * *